US006784908B2

(12) United States Patent
Shibuya

(10) Patent No.: US 6,784,908 B2
(45) Date of Patent: Aug. 31, 2004

(54) PRINTER

(75) Inventor: Masaaki Shibuya, Hino (JP)

(73) Assignee: Olympus Corporation, Tokyo (JP)

( * ) Notice: Subject to any disclaimer, the term of this patent is extended or adjusted under 35 U.S.C. 154(b) by 263 days.

(21) Appl. No.: 10/054,667

(22) Filed: Nov. 13, 2001

(65) Prior Publication Data

US 2002/0163569 A1 Nov. 7, 2002

(30) Foreign Application Priority Data

Nov. 16, 2000 (JP) ..... 2000-350117
Nov. 16, 2000 (JP) ..... 2000-350118
Nov. 16, 2000 (JP) ..... 2000-350119

(51) Int. Cl.[7] ..... B41J 2/37; B41J 2/36
(52) U.S. Cl. ..... 347/192; 347/194; 400/120.12
(58) Field of Search ..... 347/190, 192, 347/185, 176, 188, 194; 367/186; 400/120.12

(56) References Cited

U.S. PATENT DOCUMENTS 3,934,695 A 1/1976 Kovalick ..... 347/192
4,113,391 A * 9/1978 Minowa ..... 347/192
4,407,003 A * 9/1983 Fukui ..... 347/192
4,449,137 A * 5/1984 Inui et al. ..... 347/192
4,510,505 A * 4/1985 Fukui ..... 347/192
4,642,657 A * 2/1987 Asakura ..... 347/192
4,984,185 A * 1/1991 Saito ..... 347/192
5,087,923 A * 2/1992 Bruch ..... 347/192
5,191,356 A 3/1993 Shibamiya ..... 347/192
5,230,056 A 7/1993 Hoshina ..... 347/192
5,311,441 A * 5/1994 Tayama et al. ..... 347/192
5,524,993 A * 6/1996 Durst ..... 400/279
5,714,994 A * 2/1998 Suzuki et al. ..... 347/192
5,745,146 A * 4/1998 Durst et al. ..... 347/192
5,978,006 A 11/1999 Morgavi ..... 347/192
6,095,700 A * 8/2000 Negishi et al. ..... 400/120.02
6,382,774 B1 * 5/2002 Izumi ..... 347/192

FOREIGN PATENT DOCUMENTS

JP 58-5280 * 1/1983 ..... 347/192
JP 60-155475 * 8/1985 ..... 400/54
JP 02-002033 * 1/1990 ..... 347/192
JP 02-279353 * 11/1990 ..... 347/192
JP 04-113860 * 4/1992 ..... 347/192
JP 04-358853 * 12/1992 ..... 347/192
JP 05-221008 * 8/1993 ..... 347/192
JP 5-238046 9/1993
JP 6-91916 4/1994
JP 7-195729 8/1995
JP 2000-135809 5/2000

* cited by examiner

*Primary Examiner*—Huan Tran
(74) *Attorney, Agent, or Firm*—Straub & Pokotylo; John C. Pokotylo

(57) ABSTRACT

The present invention provides a printer in which a current is conducted to a thermal head 20 in order to pre-heat the thermal head 20 concurrently with battery checking prior to printing. Thereafter, power supplied from a battery is fed to the thermal head 20, which is a load, immediately before the color inks on an ink ribbon 7*a* are transferred. At the predetermined timing immediately succeeding the feeding of power (in 5 to 10 msec), a voltage developed from the battery 8 is detected. The detected voltage is corrected so that a printing density of inks transferred from the thermal head 20 will remain constant irrespective of whether the voltage developed from the battery 8 is high or low.

15 Claims, 10 Drawing Sheets

PRINTER

This application claims benefit of Japanese Application No. 2000-350117 filed in Japan on Nov. 16, 2000, Japanese Application No. 2000-350118 filed in Japan on Nov. 16, 2000, Japanese Application No. 2000-350119 filed in Japan on Nov. 16, 2000, the contents of which are incorporated by this reference.

BACKGROUND OF THE INVENTION

1. Field of the Invention

The present invention relates to a printer such as a sublimable type thermal printer having a freely attachable or detachable battery as a power supply for printing operation. More particularly, the present invention relates to a printer capable of correcting a current to be conducted to a thermal head for the purpose of stabilizing a printing density. The printer thus achieves printing with stable image quality ensured, offers improved performance, and contributes to realization of a low-cost compact design.

2. Description of the Related Art

In recent years, heat-sensitive heat-transfer printers capable of presenting high-definition images owing to the ability to print images full of colors have been widely adopted as devices that produce hardcopies of images received from a personal computer, a camera-built-in video tape recorder, an electronic still camera, or the like.

As far as a conventional heat-sensitive heat-transfer printer is concerned, print paper as well as an ink sheet is pressured against and sandwiched between a platen roller and a thermal head. The ink sheet is produced by applying a plurality of heat-sublimable color dyes to a base film, and positioned so that the heat-sublimable dyes will stick to the print paper. A plurality of heating elements are arranged on one side of the thermal head. When a current is conducted to the thermal head, the heating elements appropriately generate heat according to print data. Consequently, the heat-sublimable dyes are heated through the base film. This causes the heat-sublimable dyes to sublime. Eventually, the heat-sublimable dyes are transferred to the paper for the purpose of printing.

In the past, many proposals have been made of the foregoing types of printer and intended to improve printing quality and reduce costs. For example, Japanese Unexamined Patent Application Publication No. 5-238046 describes a battery-driven printer and Japanese Unexamined Patent Application Publication No. 7-195729 describes a heat-sensitive heat-transfer recording device.

The battery-driven printer described in the Japanese Unexamined Patent Application Publication No. 5-238046 has a rechargeable battery as a power supply that permits photo-printing. When photo-printing is not performed, a rectified dc voltage source composed of an ac rectifier, a switching unit, a voltage control unit, and a secondary rectifier, is used to charge the rechargeable battery. During photo-printing, the rechargeable battery discharges to supply power required to perform photo-printing. A voltage drop stemming from the discharge is detected. The voltage control unit controls the rectified dc voltage source so that the rectified dc voltage source will develop a dc voltage corresponding to the voltage drop. The voltage control unit then uses a charging/superposition switching unit and a superposition unit to superpose the output of the rectified dc voltage source on the output of the battery for correction. The voltage control unit thus stabilizes the power to be supplied from the battery to improve a quality of photo-printing.

Moreover, the heat-sensitive heat-transfer recording device described in the Japanese Unexamined Patent Application Publication No. 7-195729 performs thermal recording using a thermal head. An incorporated photo-printing voltage sensing unit detects a voltage applied to the thermal head, then, it develops a voltage to be applied to the thermal head based on an output voltage of a voltage adding circuit.

The voltage adding circuit adds up an output voltage of a peak-value detecting unit, which detects a peak value of an output voltage of the photo-printing voltage sensing unit, and a voltage set by a photo-printing voltage setting unit. In other words, the voltage applied to the thermal head is detected and then is controlled in order to stabilize the output voltage of the thermal head. Thus, a printing density is stabilized.

Furthermore, other proposals intended to improve printing quality include, for example, a proposal for a density/gray scale controlled printer described in Japanese Unexamined Patent Application Publication No. 6-91916 and a proposal for an image forming device described in Japanese Unexamined Application Publication No. 2000-135809.

The density/gray scale controlled printer described in the Japanese Unexamined Patent Application Publication No. 6-91916 conducts a current to heating resistance elements and records an image on print paper using the energy of heat generated from the heating resistance elements. Power is compensated based on the counted number of conducting elements. Thus, excellent color reproducibility is guaranteed on a constant basis all the time.

Moreover, the image forming device described in the Japanese Unexamined Application Publication No. 2000-135809 adopts a thermal head designed for a heat-transfer printer or a heat-sensitive printer in efforts to prevent occurrence of an uneven density among lines. Incidentally, the uneven density is attributable to the fact that the larger the number of heating resistance elements driven simultaneously among all heating resistance elements is, the smaller a current to be fed to each heating resistance element is. Herein, the number of all heating resistance elements is the same as the number of dots constituting one line. In the image forming device, calculation is performed using photo-print data representing one line. Consequently, a density can be corrected based on the pulse duration of current conduction pulses. Moreover, occurrence of an uneven density such as a white streak created between lines can be prevented.

Incidentally, there is a demand for printers that are inexpensive and able to produce high-definition prints. Moreover, printers that are compact, lightweight, and portable are strongly demanded so that printing can be performed at any time in any place.

In order to realize a portable printer capable of satisfying the above demands, the printer must be able to be driven using a battery alone. In this case, since the printer can be used even in places where an ac power supply is unavailable, its usefulness improves. When an emphasis is put on image printing, a heat-transfer printer such as the aforesaid sublimable printer is preferred because it offers high image quality.

However, the heat-transfer printer requires a large amount of power for heat-transfer printing. Moreover, since the capacity of a battery power supply is limited, occurrence of a voltage drop during use is unavoidable. As long as an ac power supply can be used, an applied voltage is held constant and unevenness in printing image quality is limited. However, when an attempt is made to use a battery alone to perform heat-transfer printing, a large obstacle must be overcome. Namely, a large voltage drop dependent on the degree of exhaustion of the battery must be coped with, and satisfactorily stable image quality must be attained.

In consideration of the above demands, the battery-driven printer described in the Japanese Unexamined Patent Application Publication No. 5-238046 is unacceptable, though it can maintain a predetermined photo-printing voltage all the time. Namely, the battery-driven printer has a drawback that it must be powered using an ac power supply but cannot be driven with a battery alone.

Moreover, the heat-sensitive heat-transfer recording device described in the Japanese Unexamined Patent Application Publication No. 7-195729 employs an assembly that detects a voltage applied to a thermal head, controls the applied voltage so that an output voltage of the thermal head will remain constant, and thus stabilizes a printing density. In addition, a peak-value detecting unit is employed for detecting the peak of a voltage so as to accurately measure the voltage applied to the thermal head. However, the heat-sensitive heat-transfer recording device is not oriented to be driven using a battery alone. The patent application publication does not describe a correction technology or the like intended to cope with a variation in an output voltage of a battery.

The conventional sublimable heat-transfer printers have a drawback that when a battery is adopted as a power supply, a large voltage drop dependent on the degree of exhaustion of the battery cannot be coped with, and printing cannot be achieved with sufficiently stable image quality ensured.

Moreover, in the thermal head employed in the heat-sublimable printer, a correlation expressed below is, generally, established relative to an amount of energy to be applied to the thermal head during photo-printing.

$$E=kV^2\ t/R \tag{1}$$

where E denotes an amount of energy that permits printing to be achieved at a certain photo-printing density, and k denotes the heat efficiency of the head. Moreover, V denotes a voltage to be applied to the head, R denotes a resistance offered by the head, and t denotes a conduction time during which a current is conducted to the thermal head.

In the printer in which the relationship provided as the expression 1 is established, important factors are what is the amount of energy E ensuring a maximum density for photo-printing and what is the conduction time during which a current is conducted to the thermal head. The amount of energy E ensuring a maximum density is pre-set to a fixed value. On the other hand, when the conduction time t is extended, the head resistance R can be increased but a printing time itself gets longer. In the case of a color printer, a printing action is performed relative to four color inks of, for example, yellow (Y), magenta (M), cyan (C), and transparent of an overcoat (OP). The printing action is therefore performed four times. If the conduction time is extended, the printing time gets very long. This is unpractical and unacceptable. Conventionally, the conduction time is made short. Accordingly, the voltage to be applied to the thermal head ranges from 22 V to 28 V, and the head resistance ranges from about 7 kΩ to about 10 kΩ. In a circuit including the thermal head, not only the thermal head offers a resistance but also the circuit itself offers a resistance. Therefore, when the applied voltage and head resistance are made high, a power loss is minimized. As long as power is supplied sufficiently, it is advantageous that the voltage and resistance are set as mentioned above.

However, when it comes to a portable printer, a very heavy battery cannot be adopted in terms of portability. In order to realize a supply voltage of 24 V, twenty nickel-hydride secondary batteries must be connected in series with one another. This contradicts the concept of a portable printer. Consequently, when a battery is selected in consideration of portability, the supply voltage ranges from about 7.2 V to about 7.6 V.

Using a dc-to-dc converter, the supply voltage is boosted to range from 22 V to 28 V as it conventionally is. The power loss caused for the aforesaid reason is overcome. However, the dc-to-dc converter causes an enormous power loss. This discourages realization of a power supply optimal to a mobile printer. When consideration is taken into an enormous power loss caused by the dc-to-dc converter, a large space occupied thereof, the weight thereof, and heat dissipated thereby, a portable printer should be designed so that a supply voltage will be applied to a thermal head as it is. Accordingly, a resistance to be offered by the thermal head is set to a proper value. This conceivably results in a heat-sublimable printer capable of satisfying the demand for portability to the maximum. In particular, a correcting means for performing correction such as printing ratio correction so as to stabilize a printing density of inks transferred from the thermal head helps satisfy such a demand for portability to the maximum.

FIG. 15 is a circuit diagram schematically showing the circuitry in accordance with a related art of a printer having an ordinary power supply. FIG. 13 and FIG. 14 concerned with an embodiment of the present invention will also be referred to in order to describe underlying problems of the printer in accordance with the related art.

The basic circuitry for a heat-sublimable printer is schematically shown in, for example, FIG. 13. Specifically, the printer has the circuitry composed of a power supply E, a resistor Rc, and a resistor Rh. The resistor Rc is a circuit element that offers a resistance. The resistor Rh offers a resistance corresponding to a resistance offered by a plurality of heating resistance elements incorporated in a thermal head. Incidentally, the plurality of heating resistance elements incorporated in the thermal head are provided the same number as the number of dots to be created, for example, 960.

When the above printer is designed to satisfy the requirements for a portable printer, the supply voltage E is, as mentioned above, set to 7.6 V, the resistance Rc is set to 1 Ω, and the resistance Rh corresponding to a resistance offered by the heating elements incorporated in the thermal head is set to 750 Ω. At this time, the number of heating resistance elements or heads that are turned on to create dots shall be N and a current flowing into the thermal head shall be i.

In the printer designed to satisfy the requirements for a portable printer, for example, when all the heating elements responsible for 960 dots are turned on, the current i flowing into each heating element is expressed as follows.

$$i=\frac{7.6}{Rc+\frac{Rh}{N}}\times\frac{1}{N}=\frac{7.6}{1+\frac{750}{960}}\times\frac{1}{960}\times 1000=4.444(\text{mA}) \tag{2}$$

When only one heating element of the thermal head is turned on to create one dot, the current i is expressed as follows.

$$i = \frac{7.6}{Rc + \frac{Rh}{N}} \times \frac{1}{N} = \frac{7.6}{1+750} \times \frac{1}{1} \times 1000 = 10.120(\text{mA}) \quad (3)$$

In order to stabilize a printing density of inks transferred from the thermal head, it is necessary to detect how many heads (heating resistance elements) incorporated in the thermal head are turned on. A voltage to be applied must then be regulated based on the result of the detection. Since the supply voltage E is fixed, voltage regulation is impossible to do. Consequently, even if a total resistance varies depending on how many heating resistance elements are turned on or off, the current flowing into each heating resistance element must be held constant. This makes it necessary to perform printing ratio correction.

Specifically, the printing ratio correction is intended to reliably reproduce a printing density. Now, when a minimum current flows (a current flows into each of 960 heating resistance elements because the elements are turned on), a correction value shall be 100%. When the number of heating resistance elements that are turned on is 1, the correction value is calculated from the numerical values provided by the expressions (2) and (3) as 4.444/10.120=43.9%. FIG. 14 graphically shows the correction coefficient for a printing ratio in relation to the number of heating resistance elements that are turned on. In other words, unless the current is reduced by up to 56% in proportion to the number of heating resistance elements that are turned on to create dots, energy to be applied to each element cannot be held constant. Consequently, the correction ranges widely.

In a printer employing an ordinary power supply, the supply voltage developed from the ordinary power supply shall be 24 V, the resistance Rc shall be 1 Ω, and the resistance R corresponding to a resistance offered by all the heating elements of a thermal head shall be 7000 Ω. In this case, for example, when all the heating elements responsible for 960 dots are turned on, the current i flowing into each heating element is expressed as follows:

$$i = \frac{24}{1 + \frac{7000}{960}} \times \frac{1}{960} \times 1000 \approx 3.015(\text{mA}) \quad (4)$$

When only one heating element is turned on to create one dot, the current i is expressed as follows:

$$i = \frac{24}{1+7000} \times \frac{1}{1} \times 1000 \approx 3.428(\text{mA}) \quad (5)$$

In this case, printing ratio correction is intended to reliably reduce a printing density. Now, when a minimum current flows (a current flows into each of 960 heating elements because the 960 heating elements are turned on), a correction value shall be 100%. When the number of heating elements that are turned on is 1, the correction value is calculated from the numerical values provided by the expressions 4 and 5 as 3.015/3.428=approx. 88.0%. In other words, as far as the printer employing an ordinary power supply is concerned, the correction ranges narrowly. Providing the printing ratio correction is not performed, only a difference in an amount of energy that can be corrected with the correction value set to 12% at most would take place.

Assume that in consideration of portability, a printer is designed to adopt 7.6 V and 750 Ω as a supply voltage and a resistance offered by a thermal head respectively as mentioned above. In this case, the correction value assumes the aforesaid values. The range of the values of the correction is much wider than that required in a printer that is designed to adopt 24 V as a supply voltage provided by an ordinary power supply and 7000 Ω as a resistance offered by a thermal head. When the correction ranges widely, how to control heat remaining in the thermal head after the thermal head is driven in order to cause the heating elements incorporated in the thermal head to generate heat becomes a big obstacle that must be overcome.

In order to overcome the obstacle, a printer may be designed to adopt 24 V as a supply voltage and 7000 Ω as a resistance offered by a thermal head, because the correction ranges narrowly. In this case, it is inferred how much heat remains in each heating resistance element when photoprinting a gray-scale level. Thus, a current flowing into each heating resistance element may be controlled. However, as mentioned above, when a printer is designed to adopt 7.6 V as a supply voltage and 750 Ω as a resistance offered by a thermal head, the correction ranges widely. In this case, it is impossible to achieve high-precision correction by inferring heat remaining in each heating resistance element and thus controlling a current that flows into each heating resistance element.

In the density/gray-scale controlled printer described in the Japanese Unexamined Patent Application Publication No. 6-91916, power is compensated based on the counted number of elements to which a current is conducted. This results in excellent color reproducibility that is stable all the time. However, the power compensation implemented in the printer is such that: the number of heating resistance elements to which a current is conducted is counted; an average resistance offered by the thermal head is corrected by referencing the data representing the number of elements to which a current is conducted and being stored in a RAM; and power to be fed to the heating resistance elements is controlled based on the corrected resistance offered by the thermal head. This poses a problem in that more sophisticated compensation cannot be expected.

In the image forming device described in the Japanese Unexamined Patent Application Publication No. 2000-135809, the technology for preventing an uneven density from occurring among lines is implemented. The uneven density is attributable to the fact that the larger the number of heating resistance elements, which are driven simultaneously, out of all the heating resistance elements that number the same as dots constituting one line, the smaller a current to be fed to each heating resistance element. Calculation is also performed using photo-printing data that represents one line. However, the patent application publication does not describe anything about correction adaptable to a printer designed to employ a battery power supply that is be preferred for portable use. The correction technology disclosed in the patent application publication has a drawback that it cannot be satisfactorily adapted to a portable printer.

Furthermore, when a printer is designed to employ a battery power supply suitable for portable use and adopt 7.6 V as a supply voltage and 750 Ω as a resistance offered by a thermal head, the correction ranges widely as mentioned above. In this case, correction cannot be achieved highly precisely by inferring heat remaining in each heating resistance element and thus controlling a current that flows into each heating resistance element.

SUMMARY OF THE INVENTION

An object of the present invention is to provide a printer in which correction is controlled so that a printing density of inks transferred from a thermal head will remain constant despite a large voltage drop dependent on the degree of exhaustion of a battery. Consequently, the printer can achieve printing with sufficiently stable image quality ensured, and can be designed to offer improved performance and to be low-cost and compact.

Another object of the present invention is to provide a printer capable of achieving correction highly precisely despite adoption of a battery power supply suitable for portable use even with a structure in which a correction of current cannot help ranging widely. Moreover, the printer can be designed to offer improved performance and to be low-cost and compact.

Briefly, according to the present invention, there is provided a printer consisting mainly of a thermal head, a battery power supply means, a voltage detecting means, and a control means. The thermal head transfers a plurality of color inks successively to paper so that a color image can be printed on the paper according to image data. The voltage detecting means detects a voltage developed from the battery power supply means. The control means feeds power supplied from the battery power supply means to a load at the timing immediately preceding the transfer of the color inks to the paper. The control means instructs the voltage detecting means to detect a voltage developed from the battery power supply means immediately succeeding the feeding of power. The control means performs correction according to the result of the detection so that a printing density of inks transferred from the thermal head will remain constant irrespective of whether the voltage developed from the battery power supply means is high or low.

Moreover, according to the present invention, there is provided a printer consisting mainly of a thermal head, a battery power supply means, a battery detecting means, a display means, a voltage detecting means, and a control means. The thermal head transfers a plurality of color inks successively to paper so that a color image will be printed on the paper according to image data. The battery detecting means detects a remaining battery capacity of the battery power supply means by conducting a current to a first load. The display means displays an indication of the fact that the remaining battery capacity detected by the battery detecting means is judged to be equal to or smaller than a battery capacity required to perform printing. The voltage detecting means detects a voltage developed from the battery power supply means. The control means feeds power supplied from the battery power supply means to a second load, which is smaller than the first load, at the timing immediately preceding the transfer of the color inks to paper. The control means instructs the voltage detecting means to detect the voltage value developed from the battery power supply means at the timing immediately succeeding the feeding of power. The control means then performs correction according to the result of the detection so that a printing density of inks transferred from the thermal head will remain constant irrespective of whether the voltage developed from the battery power supply means is high or low.

Furthermore, according to the present invention, there is provided a printer consisting mainly of a thermal head, a battery power supply means, a voltage detecting means, and a control means. The thermal head transfers a plurality of color inks successively to paper so that a color image will be printed on the paper according to image data. The voltage detecting means detects a voltage value provided by the battery power supply means. The control means then feeds power supplied from the battery power supply means to a load at the timing immediately preceding the transfer of the color inks to the paper. The control means then instructs the voltage detecting means to detect the voltage value provided by the battery power supply means at the predetermined timing immediately succeeding the feeding of power. The control means then performs correction according to the result of the detection so that a printing density of inks transferred from the thermal head will remain constant irrespective of whether the voltage developed from the battery power supply means is high or low. Herein, in the correction performed by the control means, a correction value is determined based on the voltage detected by the voltage detecting means. When the same voltage is detected with transfer of each color ink, the correction value is determined to assume the same value.

According to the present invention, there is provided a printer consisting mainly of a thermal head, a battery power supply means, a voltage detecting means, and a control means. The thermal head transfers a plurality of color inks successively to paper so that a color image will be printed on the paper according to image data. The voltage detecting means detects a voltage value provided by the battery power supply means. The control means feeds power supplied from the battery power supply means to a load at the timing immediately preceding the transfer of the color inks to the paper. The control means then instructs the voltage detecting means to detect the voltage value provided by the battery power supply means at the predetermined timing immediately succeeding the feeding of power. The control means then performs correction according to the result of the detection so that a printing density of inks transferred from the thermal head will remain constant irrespective of whether the voltage developed from the battery power supply means is high or low. Herein, owing to the correction performed by the control means, when the voltage detected by the voltage detecting means is a first voltage value, printing is achieved at a maximum density.

In addition, according to the present invention, there is provided a printer consisting mainly of a thermal head, a first correction value determining means, a second correction value determining means, and a control means. The thermal head includes a plurality of heating elements that are used to print a color image on paper according to image data. The first correction value determining means calculates a printing ratio relative to a gray-scale level specified in image data representing one line out of the image data, and determines a correction value according to calculated printing ratios. The second correction value determining means performs an arithmetic operation using gray-scale data items based on which the heating elements generate heat so as to print one line according to the image data, and determines a correction value according to the result of the arithmetic operation. The control means then controls the amounts of heat dissipated from the heating elements according to the correction values determined by the first and second correction value determining means.

The above and other objects, features and advantages of the invention will become more clearly understood from the following description referring to the accompanying drawings.

DESCRIPTION OF THE PREFERRED EMBODIMENTS

Figure 1:
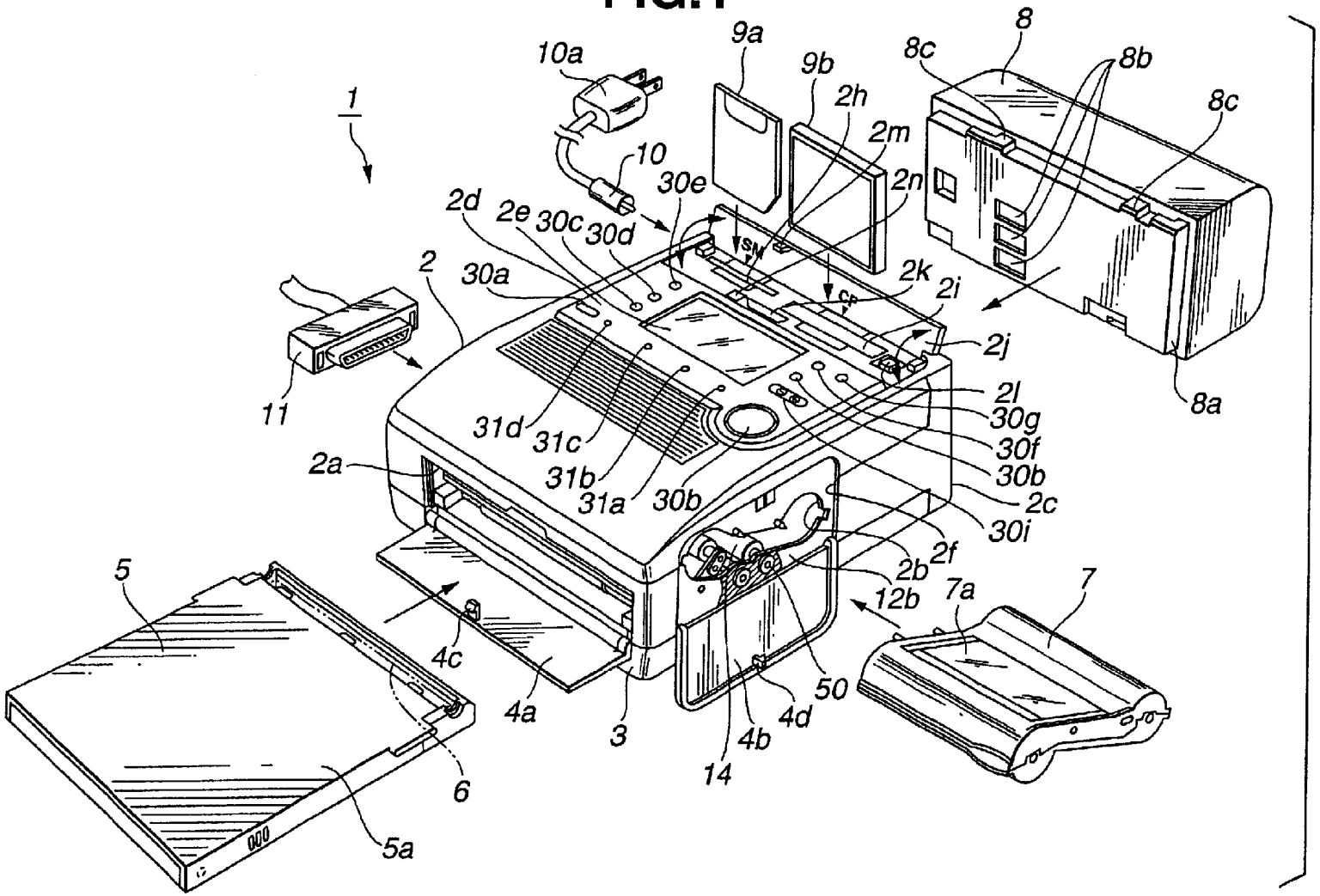
FIG. 1 is an exploded perspective view showing all components of a printer in accordance with a first embodiment of the present invention.

Referring to the drawings, embodiments of the present invention will be described below.

Figure 2:
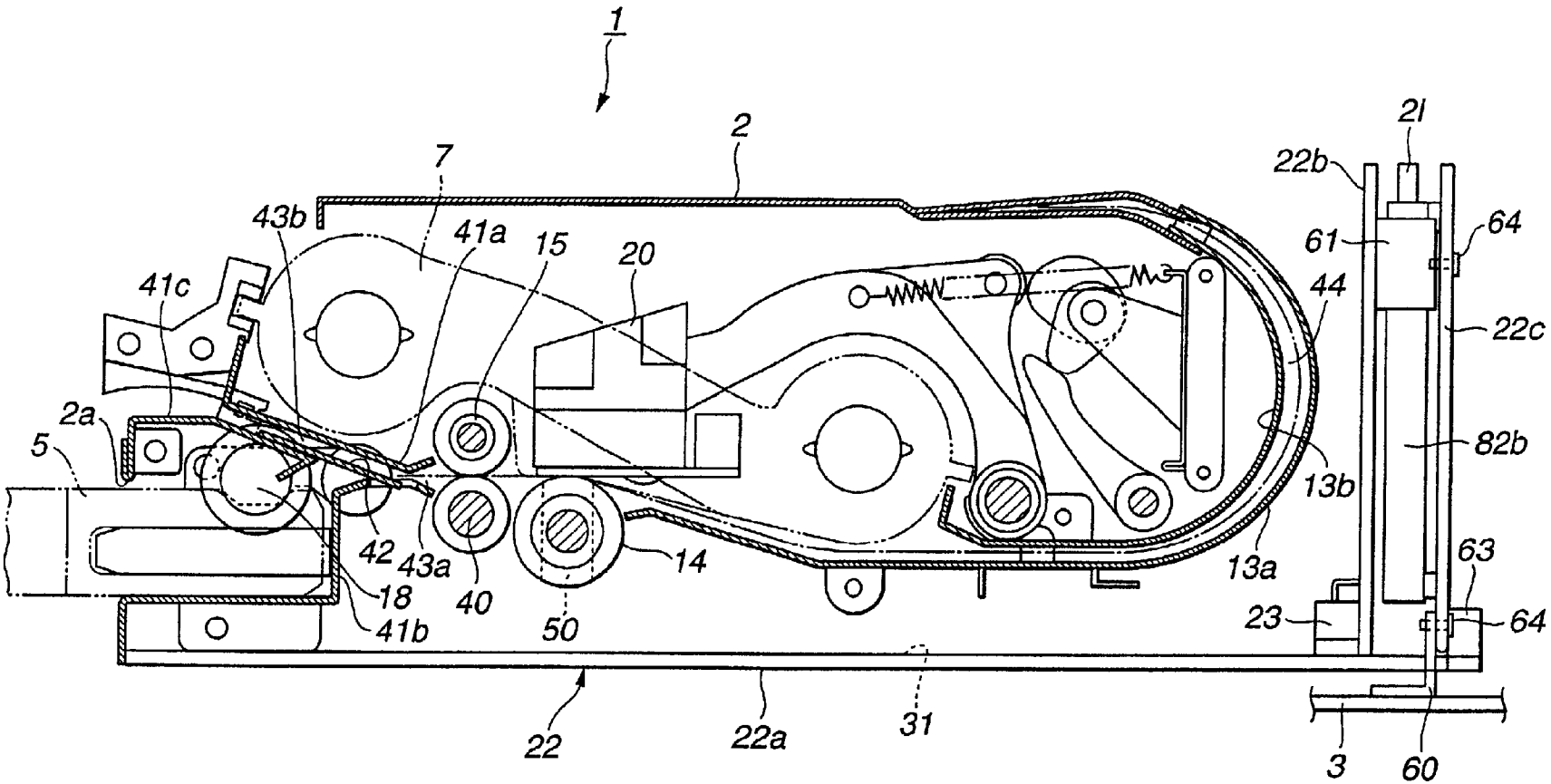
FIG. 2 is a sectional view showing a major assembly incorporated in the printer in accordance with the first embodiment.
Figure 3:
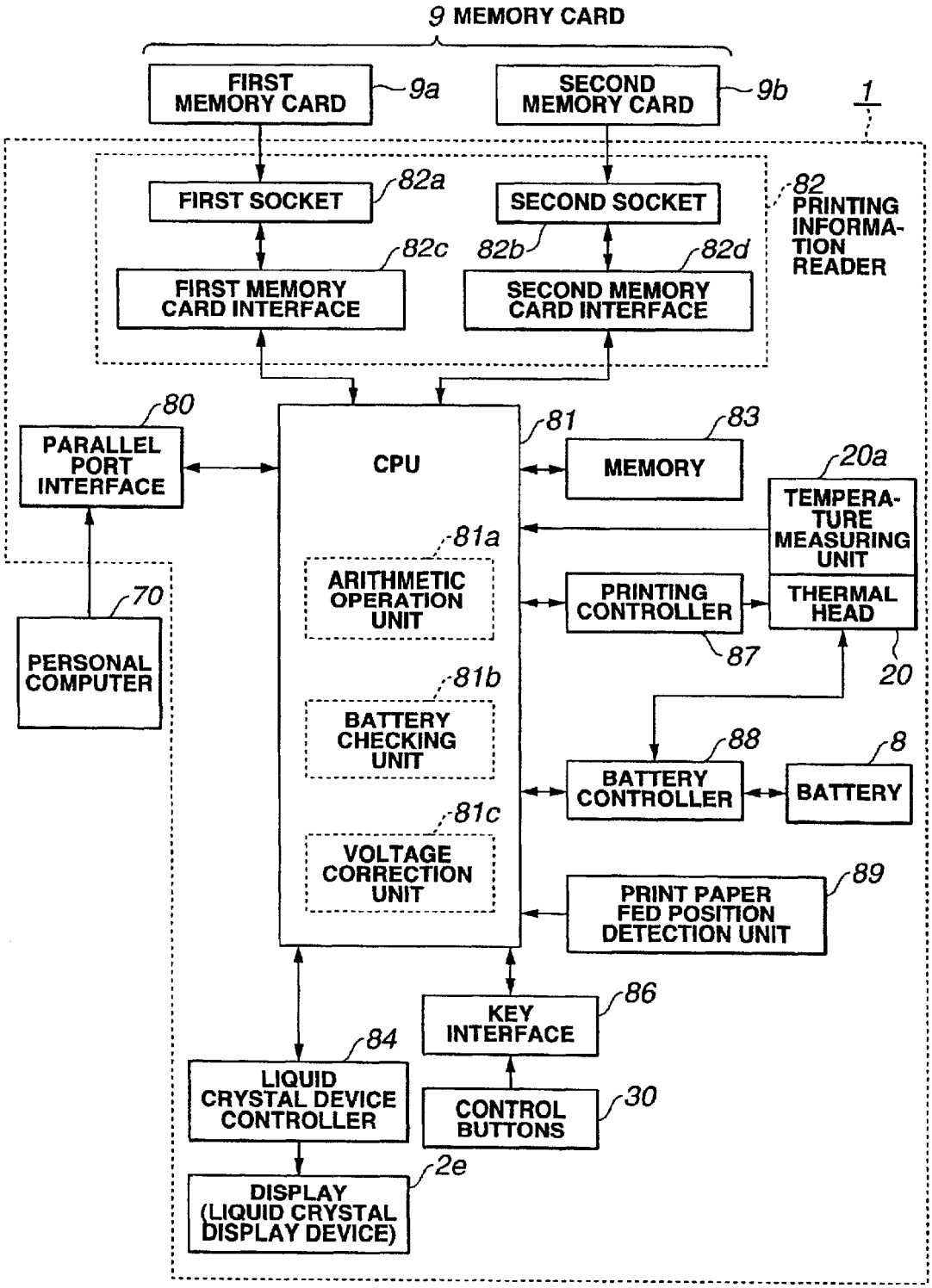
FIG. 3 is a block diagram showing the electrical circuitry of a major portion of the printer in accordance with the first embodiment.
Figure 4:
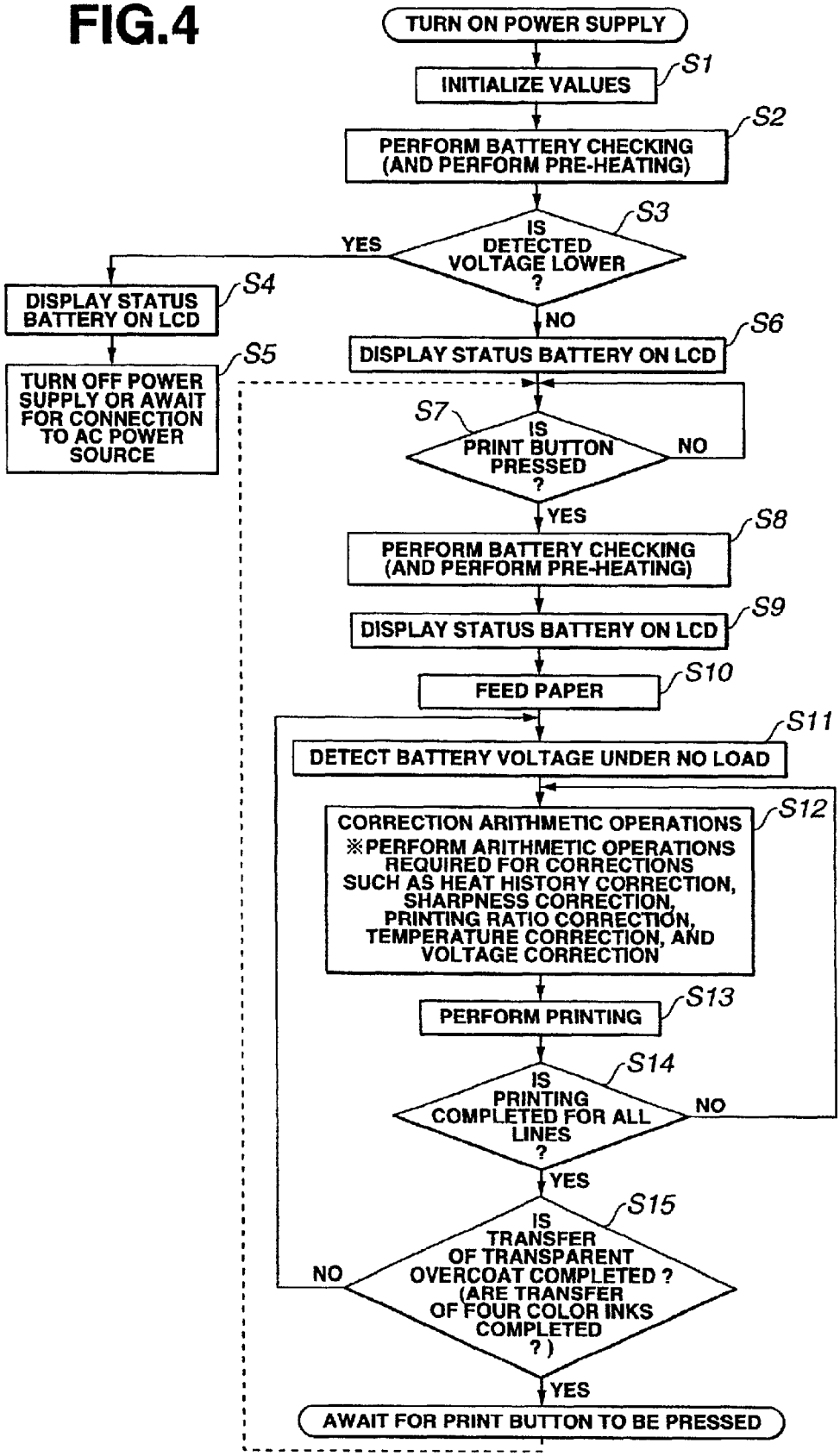
FIG. 4 is a flowchart describing control actions performed by a CPU included in the first embodiment.
Figure 5:
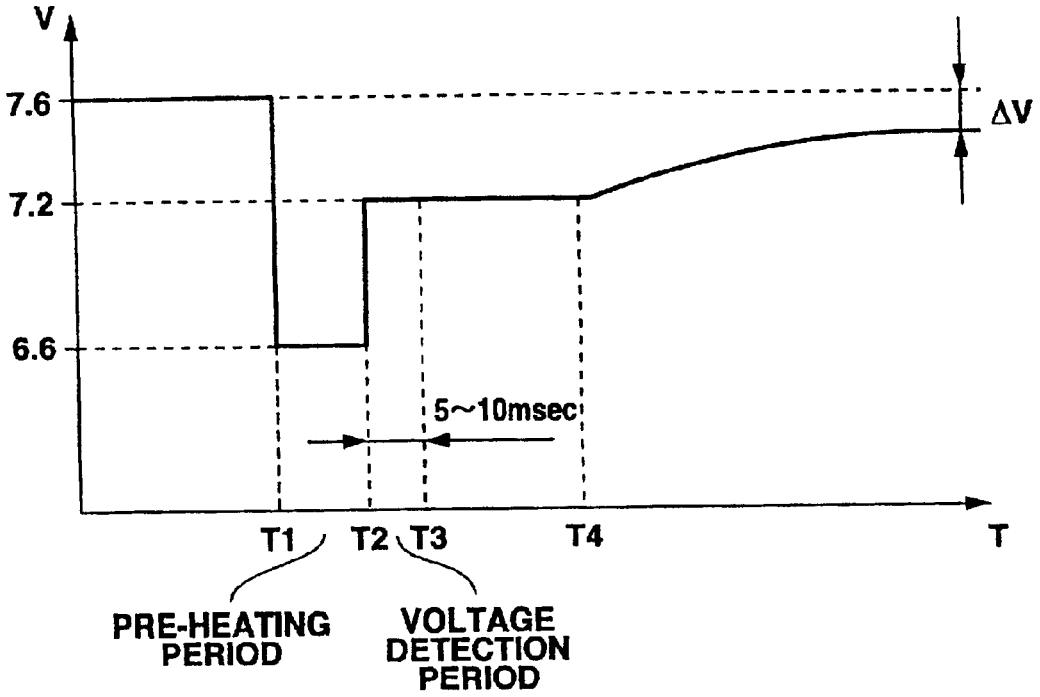
FIG. 5 is a timing chart for explaining voltage detecting operation involved in voltage correction that features the first embodiment.
Figure 6:
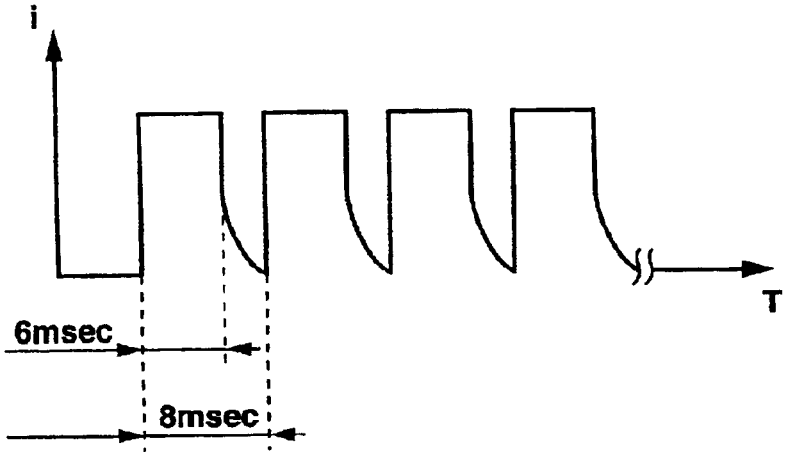
FIG. 6 is an enlarged timing chart showing applied voltage pulses during pre-heating indicated in FIG. 5.
Figure 7:
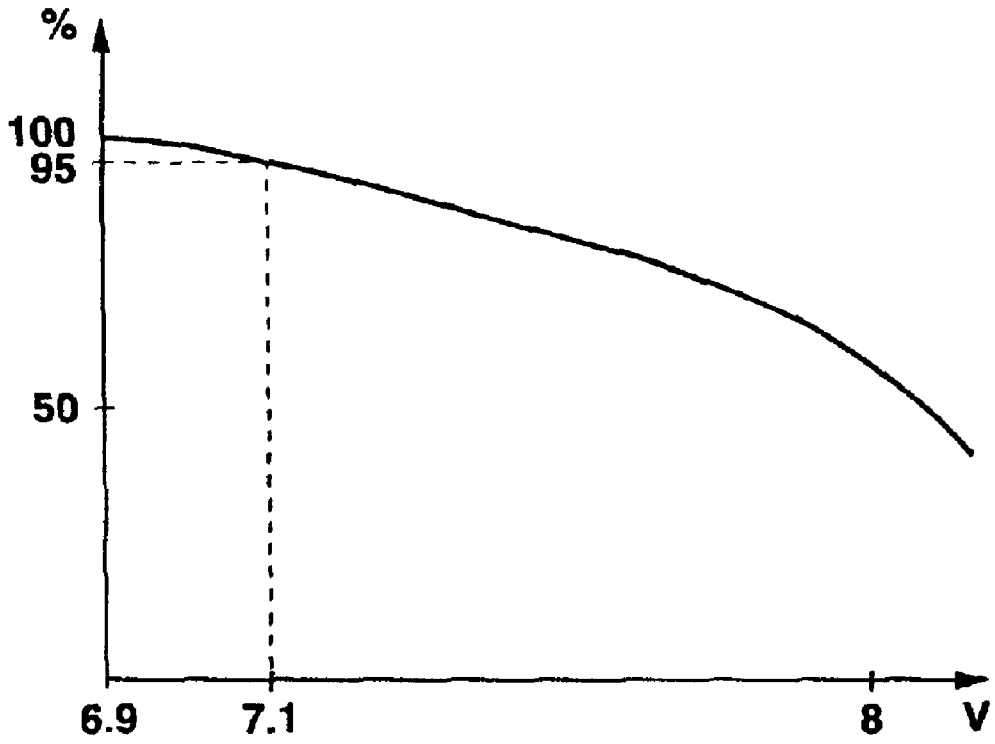
FIG. 7 shows a characteristic curve provided as table data that is used during voltage correction to be performed according to the first embodiment.

FIG. 1 to FIG. 7 show a first embodiment of the present invention. FIG. 1 is an exploded perspective view showing all components of a printer. FIG. 2 is a sectional view showing a major assembly incorporated in the printer. FIG. 3 is a block diagram showing the electrical circuitry of a major portion of the printer shown in FIG. 1. FIG. 4 is a flowchart describing control actions performed by a CPU. FIG. 5 is a timing chart for explaining voltage detecting operations involved in voltage correction. FIG. 6 is an enlarged timing chart showing applied voltage pulses during pre-heating indicated in FIG. 5. FIG. 7 shows a characteristic curve provided as table data that is used to perform voltage correction.

First, referring to FIG. 1 and FIG. 2, the components of the printer will be described briefly.

As shown in FIG. 1, the printer 1 has a housing that determines the appearance of the printer 1. The housing consists of a main unit cover 2 that accommodates various mechanisms, components, and circuit boards required for printing, and a main unit bottom 3 that bottoms the main unit cover 2.

The main unit cover 2 has a paper feed cassette loading opening 2*a* formed in the front side of the printer 1 (left front side in FIG. 1). A paper feed cassette 5 in which a plurality of sheets of print paper 6 are stacked is loaded through the paper feed cassette loading opening 2*a* so that the paper feed cassette 5 can be unloaded freely.

Moreover, an open/close lid 4*a* is attached to a predetermined portion of the main unit bottom 3 for closing the paper feed cassette loading opening 2*a* after the paper feed cassette 5 is unloaded so that the open/close lid 4*a* can be opened or closed. The open/close lid 4*a* has a lock means 4*c* with which the open/close lid 4*a* is held closed when the open/close lid 4*a* is closed. Owing to the lock means 4*c* and a locking means (not shown) formed at a position on the main unit cover 2 that coincides with the position of the lock means 4*c*, the open/close lid 4*a* is locked when the open/close lid is closed.

An opening 2*f* is formed on the right-hand side of the main unit cover 2 that is on the right-hand side thereof seeing from the front side thereof. A main frame 12*b* is exposed through the opening 2*f* and incorporated in the printer. The main frame 12*b* has an ink cassette slot 2*b*, through which an ink cassette 7 is loaded, formed therein. The ink cassette 7 has an ink ribbon 7*a* wound about a shaft !thereof. The ink ribbon 7*a* has a plurality of heat-transfer inks, that is, yellow (Y), magenta (M), and cyan (C) inks and a transparent overcoat (OP) ink applied thereto repeatedly subsequently.

An open/close lid 4*b* that closes to block the opening 2*f* is attached to the main unit cover 2 so that it can be opened or closed. Similarly to the open/close lid 4*a*, when the open/close lid 4*b* has a lock means 4*d* with which the open/close lid 4*b* is held closed after being closed. Owing to the lock means 4*d* and a locking means (not shown) formed at a position on the main unit cover 2 that coincides with the position of the lock means 4*d*, the open/close lid 4*b* is locked after the open/close lid 4*b* is closed.

A battery mounting groove 2*c* is formed on the back side of the main unit cover 2 (right rear part in FIG. 1). The battery mounting groove 2*c* makes it possible to mount a battery 8, which is a driving power supply means required for portable use, on the main unit cover 2 so that it can be dismounted freely. A fitting portion 8*a* formed as part of one surface of the battery 8 is fitted in the battery mounting groove 2*c*, whereby the battery 8 is mounted on the main unit cover 2. Locks 8*c* formed on the top of the battery fitting portion 8*a* are engaged with locking means (not shown) formed at positions in the battery mounting groove 2*c* that coincide with the positions of the locks 8*c* after the fitting portion 8*a* is fitted in the battery mounting groove 2*c*. Thus, the battery 8 is held mounted.

Moreover, a plurality of battery sections 8*b* through which power stored in the battery 8 is supplied to the printer 1 is formed on the face of the fitting portion 8*a* of the battery 8. When the battery 8 is mounted with the fitting portion 8*a* thereof fitted in the battery mounting groove 2*c*, the battery sections 8*b* come into contact with battery sections (not shown) formed on the back side of the printer 1. This causes the battery sections formed on the back side of the printer 1 to conduct, whereby power can be supplied to the printer 1.

A control panel 2*d*, a display 2*e*, and first and second memory card slots 2*h* and 2*i* are formed on the upper side of the main unit cover 2. The control panel 2*d* has control buttons 30*a* to 30*i* and indicator lamps 31*a* to 31*d*. The control buttons 30*a* to 30*i* serve as an instructing means for issuing various instructions, which instruct execution of control actions, to the printer 1. The indicator lamps 31*a* to 31*d* are realized with light-emitting diodes (LEDs) that glow to indicate the progress of printing.

The control buttons 30*a* to 30*i* will be described one by one. The control button 30*a* is a Power button used to instruct that the power supply should be turned on or off.

The control button 30*b* is a Print button used to instruct printing. The control button 30*c* is a Select Print Mode button used to select a print mode from among a standard print mode, an index print mode, an all-frame print mode, and a DPOF print mode. The control button 30*d* is a Sharpness button used to select a degree of image quality from among standard image quality, soft image quality, and sharp image quality. The control button 30*e* is a Divide button used to select the number of divisions into which a picture field is divided during division printing from among zero that means no division, 2, 4, 9, and 16. The control button 30*f* is a Date button used to designate dated printing and a dated printing indication form. The control button 30*g* is a Switch Cards button used to switch memory cards 9. The control button 30*h* is a Switch Frame No./No.-of-prints button used to switch a print frame number designation mode and a number-of-prints (number-of-copies) designation mode. The control button 30*i* includes a plus (+) button and a minus (–) button used to increase or decrease a frame number or the number of prints.

The indicator lamps 31*a* to 31*d* will be described one by one. The indicator lamp 31*a* is a printing-in-progress lamp to be lit to indicate that printing is in progress. The indicator lamp 31*b* is a ribbon/paper lamp 31*b* to be lit to indicate whether an ink ribbon has run out, a paper feed cassette is absent, or print paper is absent. The indicator lamp 31*c* is an error lamp to be lit to indicate that open/close lid 4*a* of an ink cassette 7 open or a communication error. The indicator lamp 31*d* is an access/charging lamp to be lit to indicate that charging has started. Incidentally, charging starts when the power supply is turned off using the Power button 30*a* during reading of data from the memory card 9 (during access), or with a rechargeable buttery (not shown) loaded, or with a dc connector 10 coupled.

Moreover, the display 2*e* is fitted in an opening formed in the control panel 2*d*. The display 2*e* is realized with, for example, a liquid crystal display (LCD), and displays the contents of control extended during printing by the printer 1. The contents of control are to designate a printing mode, a degree of image quality, a division mode, switching of memory cards, dated printing, switching of dated printing indication forms, a file name, or a frame number or the number of prints. Otherwise, the contents of control are to instruct the indication of a frame number or the number of prints or display of characters signifying that DPOF is not set, or the indication of a remaining battery capacity.

First and second memory card slots 2*h* and 2*i* are formed to match with sockets (not shown) formed inside the main unit. Two different types of first and second memory cards 9*a* and 9*b* on which an image information signal (that may include print control information), according to which an image is printed, are inserted through the first and second memory card slots 2*h* and 2*i*. The first and second memory cards 9*a* and 9*b* can be freely detached and attached to the associated sockets. The first memory card 9*a* is, for example, a smart medium (SM), while the second memory card 9*b* is, for example, a compact flash (CF). In the present embodiment, the types of memory cards and the number thereof are not limited to the foregoing ones. Needless to say, other types of memory cards may be used in combination.

As mentioned above, the first memory card 9*a* or second memory card 9*b* is inserted in the sockets (not shown) formed to match with the first and second memory card slots 2*h* and 2*i*. Thus, an image information signal or print control information that is needed to print an image is acquired from either of the memory cards 9.

Moreover, a dust cover 2*j* for blocking the memory card slots 2*h* and 2*i* is attached near the first and second memory card slots 2*h* and 2*i* on the main unit cover 2 so that the dust cover 2*j* can be opened or closed. An edge of the dust cover 2*j* can be readily picked up owing to a notch 2*k* formed at a predetermined position on the main unit cover 2. The dust cover 2*j* can therefore be opened readily. By opening the dust cover 2*j*, the first and second memory card slots 2*h* and 2*i* are exposed. When the dust cover 2*j* is closed, a locking claw 2*m* projecting from the edge of the dust cover 2*j* that is picked up in order to open the dust cover is fitted into a locking hole 2*n* formed in the main unit. The dust cover 2*j* is closed in order to prevent invasion of dust or the like.

Moreover, an Eject button 21 to be used to eject the second memory card 9*b* that is, for example, a compact flash is located near the second memory card slot 2*i*. In order to eject the second memory card 9*b*, the Eject button 21 is pressed. Thus, the second memory card 9*b* is ejected.

The dc connector 10 via which dc power converted from normal ac power is supplied to the printer 1 is coupled to the rear end on the lateral face opposite the lateral face of the main unit cover 2 having the ink cassette slot 2*b*. The dc connector 10 can be freely uncoupled. Ac power is taken with an ac plug 10*a* inserted into an outlet. An ac-to-dc converter (not shown) arranged within the ac plug 10*a* or between the ac plug 10*a* and dc connector 10 is used to convert the ac power into dc power. The dc power is supplied as driving power to the printer 1 via the dc connector 10.

In the printer 1 of the present embodiment, an image information signal can be acquired not only from the first or second memory card 9*a* or 9*b* but also from, for example, a personal computer or video recording/reproducing equipment. Specifically, a PC connector (not shown) with which a PC connector 11 fixed to a cable extending from the personal computer or video recording/reproducing equipment is detachably connected is formed in the front part of the lateral face of the main unit cover 2. In the printer 1 of the present embodiment, therefore, not only the image information signal can be fetched from the first and second memory cards 9*a* and 9*b* but also other various image information signals can be fetched via the PC connector 11 fixed to a cable extending from any of various types of imaging equipment. This leads to an expanded range of applications.

Moreover, a plurality of sheets of print paper 6 can be stacked in the paper feed cassette 5 employed in the printer 1. The paper feed cassette 5 has a detachable cover 5*a* on a top thereof. The cover 5*a* has its distal portion, which is first inserted into the printer, notched. The uppermost one of the plurality of sheets of print paper 6 is exposed through the notched portion. When the paper feed cassette 5 is inserted, the distal portion of the paper feed cassette 5 is located in place. Consequently, a paper feed roller (not shown) incorporated in the printer 1 is brought into contact with the one sheet of print paper 6 exposed through the notched portion of the cover 5*a*. When the paper feed roller rotates, the one sheet of print paper 6 is reliably transported into the inside of the printer.

A circuit board 22 is, as shown in FIG. 2, located on the bottom of the printer 1, and composed of a control circuit board 22*a*, a power circuit board 22*b*, and a medium socket unit circuit board 22*c*. The control circuit board 22*a* mounts at least one of circuits in a group required for printing, for example, an IC (not shown) for controlling print paper feed and an IC (not shown) for controlling ink ribbon feed. The power circuit board 22*b* is fixed to the control circuit board 22*a* so that it will stand along one side of the printer 1, and includes a charging circuit capable of charging the battery 8. The medium socket unit circuit board 22*c* has sockets 82*a* and 82*b* (see FIG. 3), in which the first and second memory cards 9*a* and 9*b* are fitted, fixed thereto.

One edge of the power circuit board 22*b* is coupled to the control circuit board 22*a* via a connector 23 that is attached near one edge of the control circuit board 22*a* and serves as a coupling means. Moreover, one edge of the medium socket unit circuit board 22*c* is coupled to the control circuit board 22*a* via a connector 63 that is attached to the one edge of the control circuit board 22*a* and serves as a coupling means. Since the circuit boards are thus attached to one another, the circuit board 22 is shaped substantially like letter L as a whole. The circuit board 22 is thus structured suitably for the compact design of the device.

Moreover, a group of circuits required for printing, for example, an IC for controlling print paper feed, an IC for controlling ink ribbon feed, and a video signal processing circuit are mounted on the control circuit board 22*a*. The PC connector with which the PC connector 11 is mated so that the PC connector 11 can be separated freely is located along a side edge of the control circuit board 22*a* on the control circuit board 22*a*. Moreover, a plurality of connectors (not shown) via which various electronic components (not shown) incorporated in the printer 1 are electrically connected are arranged along the frontal edges of the control circuit board 22*a*. The circuits and connectors are electrically interconnected over a printed circuit pattern 31 that is provided on the control circuit board 22*a* in order to realize required connections.

The power circuit board 22*b* is structured so that when it is combined with the control circuit board 22*a* using the connector 23, an L-shaped assembly can be constructed. The power circuit board 22*b* is electrically connected to various electronic elements mounted on the control circuit boards 22*a* via the connector 23. Moreover, a charging circuit for charging the battery 8 and a control IC for controlling the thermal head 20 and a thermal head driving mechanism are mounted on the inner side of the power circuit board 22*b*, though they are not shown. A connector (not shown) via which the power circuit board 22*b* is electrically connected to the thermal head driving mechanism or a large-size capacitor is located at an end of one lateral side of the power circuit board 22*b*.

On the other hand, the medium socket unit circuit board 22*c* has, as shown in FIG. 2, a first memory card socket 82*a* and a second memory card socket 82*b* fixed to the inner side thereof using a fixing member 61. The fixing member 61 is fixed to the power circuit board 22*b*. The sockets 82*a* and 82*b* are fixed by tightening screws 64 that are inserted into the proximal part of the fixing member 61 through the medium socket unit circuit board 22*c*.

Moreover, the medium socket unit circuit board 22*c* is fixed to a supporting member 60 by tightening other screws 64 in order to ensure a certain degree of strength against a depressing force generated with insertion of various memory cards. The proximal part of the supporting member 60 is fixed to the inner surface of the main unit bottom 3. In other words, when the medium socket unit circuit board 22*c* is fixed to the supporting member 60, breakage of equipment due to the depressing force generated with insertion of various memory cards 9*a* and 9*b* can be prevented.

A connecting member electrically connected to the charging circuit created on the power circuit board 22*b* is mounted on the back face of the medium socket unit circuit board 22*c*, though the connecting member is not shown. The connecting member has battery sections jutted out therefrom. The battery sections come into contact with the battery sections 8*b* of the battery 8 and thus electrically conduct. When the battery 8 is fitted in the battery mounting groove 2*c* of the main unit cover 2, the battery sections of the connecting member come into contact with the battery sections 8*b* of the battery 8 and thus conduct. Consequently, power supplied from the battery 8 is fed to the inside of the printer 1.

Owing to the foregoing components, the lengths of connections can be shortened and the printer 1 can be designed to be compact and lightweight. This results in a printer optimal for portable use. Moreover, when consideration is taken into a circuit board manufacturing process, since the circuit board 22 is composed of three circuit boards 22*a*, 22*b*, and 22*c*, the jobs of manufacturing the circuit boards can be assigned to separated steps. Moreover, the circuit boards can be assembled readily. This simplifies the manufacturing process and largely contributes to a reduction in costs.

The basic movements made in the printer having the aforesaid components will be described with reference mainly to FIG. 2.

First, an uppermost one of the plurality of sheets of print paper 6 stacked in the paper feed cassette 5 is carried into the inside of the printer 1 by means of a paper feed roller 18. At this time, since the portion of the paper feed cassette 5 that lies on the proximal side of the printer where the paper feed cassette 5 is inserted is R-shaped, the print paper 6 is smoothly carried with the rotation of the paper feed roller 18.

Guide panels 41*a*, 41*b*, and 41*c* that define print paper feeding paths 43*a* and 43*b* are placed on a stage preceding a pinch roller 15 and a grip roller 40 located in the front inner space of the printer 1. The print paper 6 carried by the paper feed roller 18 thrusts up a tape member 42 that is attached to the guide panel 41*c*, and travels along the defined feeding path 43*a*. The print paper 6 is then sandwiched between the pinch roller 15 and grip roller 40. At this time, a sensor located near the feeding path defined with the guide panel 41*b* and serving as a print paper-fed position detection unit detects whether the print paper 6 has been fed normally. Based on the result of the detection, a CPU 81 (see FIG. 3) that is a major control unit and mounted on the control circuit board 22*a* determines whether printing has started. If the print paper is not fed normally, the CPU 81 instructs display of an error indication on the display 2*e* included in the main unit cover 2. Otherwise, the CPU 81 controls driving of a mechanism so as to start printing.

When printing is started, the pinch roller 15 and grip roller 40 sandwich the print paper 6, and the CPU 81 controls driving of a print paper feeding/ribbon feeding mechanism. The grip roller 40 having an anti-sliding means applied to the surface thereof is driven to rotate, whereby feeding of the print paper 6 for printing is controlled. Specifically, the feeding of the print paper 6 is controlled so that the distal part of the print paper 6 will be fed along a feeding path 44 defined by the guide panels 13*a* and 13*b* until the rear end of the print paper 6 reaches a printing start point, that is, a contact point between the thermal head 20 and a platen roller 14.

During printing, the print paper 6 and an ink ribbon 7*a* are pressured and moved forward while being sandwiched between the thermal head 20 and platen roller 14 with the rotations of the grip roller 40 and pinch roller 15. A control circuit mounted on the power circuit board 22*b* then causes a current to flow into the heating elements of the thermal head 20. Consequently, the heat-transfer inks on the ink ribbon 7*a* are melted or sublimed and then transferred to the print paper 6 for printing. An ink ribbon feed control circuit controls feeding of the ink ribbon 7*a* needed for the printing.

In this case, in order to transfer the first color ink of yellow (Y) on the ink ribbon 7*a* to the print paper 6, the pinch roller 15 and grip roller 40 cooperate with each other in feeding the print paper 6 leftwards in the drawing. The print paper 6 and ink ribbon 7*a* are pressured and moved forward while being sandwiched between the thermal head 20 and platen roller 14, and then carried. Meanwhile, an image information signal representing yellow (Y) is applied to the heating elements (not shown) of the thermal head 20.

At this time, the distal end of the print paper 6 is located in the print paper feeding path 44 defined with the guide panel 13*a* that is shaped like letter U and the guide panel 13*b* that is placed inside the guide panel 13*a* and shaped similarly to the guide panel 13*a*. On the other hand, the rear end of the print paper 6 thrusts down the tape member 42, which is attached to the guide panel 41*c*, while traveling along the feeding path 43*a*, and thus carried to the print paper feeding path 43*b*. Consequently, the first color ink is transferred.

As for a position at which the thermal head 20 is located during printing, a thermal head driving mechanism can switch, for example, three positions; that is, an upper position, a lower position at which the thermal head is illustrated to lie in FIG. 2, and a partial position that is an intermediate position at which the thermal head is on standby. The CPU 81 controls the position of the thermal head 20 according to the progress of printing.

When the transfer of the first color ink of yellow (Y) to the print paper 6 is completed, the CPU 81 controls driving of the thermal head driving mechanism (not shown), separates the thermal head 20 from the platen roller 14, and thus moves the thermal head 20 to the partial position. On the other hand, the pinch roller 15 and grip roller 40 cooperate with each other in returning the print paper 6 to the rear space in the printer 1 (rightwards in the drawing). Thereafter, the aforesaid movements are repeated in order to thus superpose the second color ink of magenta (M), the third color ink of cyan (C), and the transparent overcoat (OP) successively on the print paper 6. Color printing is thus completed.

The print paper 6 is carried to the rear space in the printer 1 (rightwards in the drawing) by means of the grip roller 40 and pinch roller 15 until the transfer of each color ink is started. At this time, the distal end of the print paper 6 is carried along the print paper feeding path 44 defined by the U-shaped guide panels 13*a* and 13*b*. When a sensor that is not shown detects the rear end of the print paper 6, the rotations of the pinch roller 15 and grip roller 40 are controlled based on the result of the detection. Consequently, the rear end of the print paper 6 is positioned at the printing start point that is the contact point between the thermal head 20 and platen roller 14.

Moreover, when the heat-transfer inks on the ink ribbon 7*a* are transferred to the print paper 6 by means of the heating resistance elements of the thermal head 20, a contact position at which the platen roller 14 comes into contact with each heating resistance element of the thermal head 20 may not coincide with a normal position, that is, may be deviated from the normal position. In this case, a pair of bushes 50 is selected based on the positional deviation in order to make the rotation shaft of the platen roller 14 eccentric. Thus, the contact position can be adjusted to coincide with the normal position.

When transfer of all color inks is completed, the printed print paper 6 is discharged to outside the printer along the print paper feeding path 43*b* by means of a discharge paper feeding mechanism that is not shown. Printing operation is thus completed. After printing operation is completed, whether the print paper 6 has been discharged is detected by another sensor serving as a print paper fed position detecting unit. The result of the detection is transferred to the CPU 81, whereby the timing that printing of one picture frame is completed is recognized.

In the printer of the present embodiment having the aforesaid components, as mentioned above, a battery is used as a power supply in efforts to realize a portable printer. Efforts have also been made to cope with a large voltage drop dependent on the degree of exhaustion of the battery and thus to print images with satisfactorily stable image quality ensured. Consequently, even when a battery is adopted as a power supply, the performance of a printer can be improved and the printer can be designed to be so low-cost and compact as to suit portable use. Referring to FIG. 3 to FIG. 7, a constituent feature for realizing the printer will be described below.

In order to offer the improved performance even when a battery is adopted as a power supply, the printer 1 is designed as mentioned below. Namely, power supplied from the battery 8 is fed to the thermal head at the timing immediately preceding transfer of color inks to the print paper 6. A voltage developed from the battery 8 is detected at the predetermined timing immediately succeeding the feeding of power. Correction is performed based on the result of the detection so that a printing density of inks transferred from the thermal head will remain constant irrespective of whether the voltage developed from the battery 8 is high or low.

As shown in FIG. 3, the printer 1 includes at least a parallel port interface 80, the CPU 81 serving as a control means, a printing information reader 82, a memory 83, a liquid crystal device controller 84, the control buttons 30, a key interface 86, a printing controller 87, a battery controller 88, a print paper fed position detecting unit 89, the thermal head 20, a temperature measuring unit 20*a*, the battery 8, and the display 2*e*.

The parallel port interface 80 is connected to a personal computer 70, thus serving as a communicating means for transferring electronic data to or from the personal computer 70. An image-to-be-printed signal is received from the personal computer 70 via the parallel port interface 80.

The print information reader 82 has the first and second memory cards 9*a* and 9*b* (generically termed memory cards 9) loaded therein so that the cards can be unloaded freely. An image-to-be-printed signal and printing control information are read from the memory cards 9*a* and 9*b* into the printer 1. Otherwise, data is written in the memory cards 9*a* and 9*b*. The printing information reader unit 82 consists of the first and second sockets 82*a* and 82*b* and the first and second memory card interfaces 82*c* and 82*d*.

The first memory card 9*a* (SM) is loaded in the first socket so that it can be unloaded freely. An image-to-be-printed signal and printing control information recorded in the first memory card 9*a* is fetched into the CPU 81 via the first memory card interface 82*c* electrically connected to the first socket 82*a*. Moreover, an image information signal can be transmitted via the first memory card interface 82*c* and written on the first memory card 9*a* through the first socket 82*a*.

Moreover, the second memory card 9*b* (CF) is loaded in the second socket 82*b* so that it can be unloaded freely. An image-to-be-printed signal and printing control information recorded on the second memory card 9*b* are fetched into the CPU 81 via the second memory card interface 82*d* that is electrically connected to the second socket 82*b*. Moreover, an image information signal can be transmitted via the second memory card interface 82*d* and written on the second memory card 9*b* through the second socket 82*b*.

The memory 83 is a storage means in which an image-to-be-printed signal read from the first or second memory card 9*a* or 9*b* or data transferred from the personal computer 70 is stored under the control of the CPU 81.

The liquid crystal device controller 84 transfers a liquid crystal display signal and a liquid crystal-control signal to the display 2*e* that is a display means so as to control display of an image on the display 2*e* under the control of the CPU 81.

The key interface 86 transfers an instruction signal, which is produced with a press of any of the control buttons 30, to the CPU 81. For example, when execution of printing is instructed by pressing the Print button 30*b*, an instruction signal indicating execution of printing is transferred to the CPU 81.

The printing controller 87 transmits a printing signal and a printing control signal to the thermal head 20 so as to control printing. Moreover, the printing controller 87 controls driving of the print paper/ribbon feeding mechanism that is not shown according to the progress of printing.

A battery controller 88 converts power supplied from the battery 8 into power of a predetermined value associated with each block, and then feeds the power to the CPU 81. Moreover, the battery controller 88 feeds power determined with a voltage (for example, 7.6 V) developed from the battery 8 to the thermal head 20. The battery controller 88 detects a battery capacity of the battery 8 prior to start of printing, and transmits the detected remaining battery capacity to the CPU 81. At the timing immediately preceding transfer of the color inks on the ink ribbon 7*a* to the print paper 6, power supplied from the battery is fed to the thermal head 20. The battery controller 88 detects the voltage developed from the battery 8 at the predetermined timing immediately succeeding the feeding of power, and transmits the result of the detection to the CPU 81.

The temperature measuring unit 20*a* for measuring the temperature of the thermal head 20 is located near the thermal head 20. The temperature measuring unit 20*a* measures the temperature of the thermal head 20, or more particularly, the temperature of a heating element included in the thermal head 20, and transmits the result of the measurement to the CPU 81.

The print paper fed position detecting unit 89 has a plurality of sensors arranged near positions on the print paper feeding paths at which the print paper 6 is absorbed, and positions thereon at which the print paper 6 is discharged. The plurality of sensors produce a timing signal indicating the timing of absorbing the print paper 6 and a timing signal indicating the timing of discharging the print paper 6. The timing signals are transmitted to the CPU 81.

The CPU 81 serving as a control means has at least an arithmetic operation unit 81*a*, a battery checking unit 81*b*, and a voltage correction unit 81*c* incorporated therein. The CPU 81 controls interpretation of data communicated from the personal computer 70, interpretation of data produced with a press of each control button 30, and interpretation of printing control information read from the first or second memory card 9*a* or 9*b*. Moreover, the CPU 81 controls storage of image-to-be-printed data read from the first or second memory card 9*a* or 9*b* in the image memory 83, display of an indication on the display 2*e*, photo-printing to be performed by the thermal head 20, and correction of a voltage applied to the thermal head. Moreover, the CPU 81 controls driving of the print paper/ribbon feeding mechanism that is not shown, calculation of a remaining battery capacity of the battery 8, and judgment of whether a battery capacity required for achieving printing of one sheet of paper is available.

Moreover, prior to execution of printing, the CPU 81 uses the battery checking unit 81*b* to judge from a battery capacity detected by the battery controller 88 whether printing of at least one sheet of paper can be achieved. If it is judged that printing of one sheet of paper cannot be achieved because of an insufficient battery capacity (that is, the remaining battery capacity of the battery 8 is equal to or smaller than a voltage required for printing), the CPU 81 controls the printing controller 88 so that the printing controller 88 will suspend printing. The CPU 81 then controls the liquid crystal device controller 84 so that the liquid crystal device controller 84 will display an indication of the fact on the display 2*e*.

Furthermore, in order to control correction of a voltage to be applied to the thermal head 20, the CPU 81 uses the battery controller 88 to detect a voltage developed from the battery 8 at the predetermined timing immediately succeeding feeding of power supplied from the battery 8 to the thermal head 20. Herein, the power supplied from the battery 8 is fed to the thermal head 20 at the timing immediately preceding transfer of the color inks on the ink ribbon 7*a* to the print paper 6. Moreover, the CPU 81 uses the arithmetic operation unit 81*a* and voltage correction unit 81*c* to perform correction according to the result of the detection so that a printing density of inks transferred from the thermal head 20 will remain constant irrespective of whether the voltage developed from the battery 8 is high or low.

The arithmetic operation unit 81*a* performs an arithmetic operation required to correct an applied voltage using the result of detection performed by the battery controller 88 in order to detect a voltage applied to the thermal head 20. For example, the arithmetic operation unit 81*a* performs arithmetic operations required to perform various corrections, such as, thermal history correction, sharpness correction, printing ratio correction, and temperature correction, and thus obtains the results of arithmetic operations.

Moreover, the voltage correction unit 81*c* determines an optimal conduction time during which a current is conducted to the thermal head 20 and during which printing can be achieved with satisfactorily stable image quality ensured dependent on the degree of exhaustion of the battery 8 irrespective of a large voltage drop. For this purpose, the voltage correction unit 81 references a voltage correction map incorporated therein using a voltage detected at the predetermined timing immediately succeeding feeding of power supplied from the battery 8 to the thermal head 20. Incidentally, the power supplied from the battery 8 is fed to the thermal head 20 at the timing immediately preceding transfer of the color inks on the ink ribbon 7*a*.

The CPU 81 controls the printing controller 87 and battery controller such that the conduction time during which a current is conducted to the thermal head 20 will be adjusted based on the result of correction that is finally determined based on the results of the various corrections and the result of the previously mentioned voltage correction. Consequently, the printing density of inks transferred from the thermal head 20 remains constant irrespective of whether the voltage developed from the battery 8 is high or low. And printing can be performed in compliance even with a large voltage drop dependent on the degree of exhaustion of the battery 8 and a satisfactorily stable image quality is ensured.

Incidentally, according to the present embodiment, a printing density on the print paper 6 is determined with the temperature of each heating element included in the thermal head 20. When the thermal head is still cool as if to be immediately after start of printing or when an ambient environment is severe, measures must be taken in order to ensure stable printing definition without a deterioration of the printing density. Therefore, according to the present embodiment, the CPU 81 feeds power supplied from the battery 8 to the thermal head 20 while having the battery checking unit 81*b* thereof engaged in battery checking. In other words, the CPU 81 controls the battery controller 88 so that a current will flow into the heating elements in the thermal head 20 so as to pre-heat the heating elements.

Since the heating elements included in the thermal head are also used as a load required to achieve battery checking, the necessity of a load dedicated to battery checking is obviated. This contributes greatly to realization of a compact printer.

Next, the control actions featuring the printer shown in FIG. 3 will be described with reference to FIG. 4 to FIG. 7.

Assume that a user has pressed the Power button 30*a* of the printer 1 shown in FIG. 1 so as to turn on the power supply of the printer.

The CPU 81 then runs a routine that involves a series of basic movements for printing that has been described with reference to FIG. 2. Specifically, the CPU 81 activates the routine described in FIG. 4. At step S1, the entire printer 1 is electrically and mechanically initialized prior to printing. Control is then passed to step S2.

At step S2, the CPU 81 executes battery checking. The battery checking works as pre-heating too. Specifically, the CPU 81 uses the battery checking unit 81*b* thereof to check a battery capacity detected by the battery controller 88. Concurrently, the CPU 81 controls the battery controller 88 so that power supplied from the battery 8 will be fed to the thermal head 20, that is, a current will flow into the heating elements included in the thermal head 20 for a predetermined period for the purpose of pre-heating. In other words, the heating elements in the thermal head are utilized as a load needed to perform battery checking.

For example, when the voltage developed from the battery 88 is 7.6 V as shown in FIG. 5, the CPU 81 controls the battery controller 8 so that a current will be conducted to the heating elements in the thermal head 20 for a predetermined period from a time instant T1 to a time instant T2 for the purpose of pre-heating. Moreover, the voltage (for example, 6.6 V) developed from the battery 8 during the period is detected in order to perform battery checking.

A current is conducted to the thermal head 20 in the form of a plurality of current pulses shown in, for example, FIG. 6. During the pre-heating period, as shown in FIG. 6, a current of a predetermined value is conducted during a period of, for example, 6 msec. The conduction is succeeded by a pause of 2 msec, and the pause is succeeded by the conduction again. In other words, the conduction of the current pulses is performed a plurality of times at intervals of 8 msec. Consequently, even when the thermal head is still cool as if to be immediately after start of printing or even when an ambient environment is severe, pre-heating can be performed in order to ensure stable printing definition without a deterioration of a printing density. The pre-heating causes the heating elements included in the thermal head 20 to generate heat.

The CPU 81 passes control to step S3. At step S3, it is judged from a voltage detected by performing battery checking at step S2 (voltage detected during the period from the time instant T1 to the time instant T2 in FIG. 5) whether printing of at least one sheet of paper can be achieved. If it is judged that printing of at least one sheet of paper cannot be achieved because of an insufficient battery capacity (that is, the remaining battery capacity of the battery 8 is equal to or smaller than a voltage required for the printing (for example, 6.6 V)), the CPU 81 controls the liquid crystal device controller 84 at step 4 so that an indication of the fact that printing is impossible to do will be displayed on the display 2*e*. At step S5, the CPU 81 controls the battery controller 88 so that the feeding of power will be discontinued in order to suspend execution of printing. In other words, when the CPU 81 performs this action, the printer 1 enters a wait state to await until the battery is charged or ac power is fed via the dc connector 10.

In contrast, it may be judged at step S3 that a voltage detected by performing battery checking (voltage detected during the period from the time instant T1 to the time instant T2 in FIG. 5) is equal to or higher than a voltage (for example, 6.6 V) that permits printing of at least one sheet of paper. In this case, the CPU 81 controls the liquid crystal device controller 84 at step 6 so that an indication of the fact that the voltage developed from the battery 8 permits execution of printing will be displayed on the display 2*e*.

Thereafter, the CPU 81 passes control to step S7. At step S7, the CPU 81 identifies an instruction signal received via the key interface 86, and judges whether the Print button 30*b* has been pressed. If the Print button 30*b* is not pressed, the judgment of step S7 is repeated until the Print button 30*b* is pressed. In contrast, if it is judged that a user has pressed the Print button 30*b*, the CPU 81 passes control to step S8. The CPU 81 thus extends control so that battery checking and pre-heating will be performed similarly to step S2. At step S9, the CPU 81 controls the liquid crystal device controller 84 similarly to step S6 so that an indication of the fact that the battery 8 develops a voltage permitting execution of printing will be displayed on the display 2*e*. Control is then passed to step S10.

At step S10, the CPU 81 controls, as one of printing actions, driving of the print paper/ribbon feeding mechanism according to the result of detection performed by the print paper-fed position detecting unit 89. Consequently, the feeding of the print paper 6 is controlled so that the distal part of the print paper 6 will travel along the print paper feeding path 44 defined by the guide panels 13*a* and 13*b*. At this time, the rear part thereof will reach the printing start point that is a contact point between the thermal head 20 and platen roller 14 (see FIG. 2).

Thereafter, the CPU 81 passes control to step S11 of correction that is a constituent feature of the present invention. At step S11, a voltage developed from the battery with no load connected to the battery is detected. Specifically, the CPU 81 detects the voltage at the predetermined timing immediately succeeding feeding of power supplied from the battery 8 to the thermal head 20, that is, voltage at the predetermined timing immediately succeeding passage of the time instant T2 shown in FIG. 6. Herein, the power supplied from the battery 8 is fed to the thermal head 20 at the timing immediately preceding transfer of the color inks on the ink ribbon 7*a* to the print paper 6. The CPU 81 receives the result of detection as a voltage to be used for voltage correction.

As shown in FIG. 5, the immediately preceding timing is the timing within a period which immediately succeeds discontinuation of conduction of a current and during which the voltage developed from the battery 8 assumes a substantially constant value (from a time instant T2 to a time instant T4). Herein, a current is conducted to the thermal head 20 during a period from a time instant T1 to the time instant T2, whereby power supplied from the battery 8 is fed to the thermal head 20 in order to pre-heat the thermal head 20 at the step S8. More particularly, the immediately preceding timing is the timing within a period of 5 to 10 msec long from the time instant T2 that immediately succeeds the discontinuation as shown in FIG. 5 (from the time instant T2 to a time instant T3). Thus, the CPU 81 detects and acquires a voltage applied to the thermal head 20 at the above timing. Moreover, the conduction of a current to the thermal head 20 during the period from the time instant T1 to the time instant T2 during which the applied voltage is detected is achieved using a smaller number of pulses than the number of pulses applied to the thermal head 20 during the pre-heating period.

Thereafter, the CPU 81 passes control to step S12. At step S12, the CPU 81 performs arithmetic operations required for corrections. The corrections requiring the arithmetic operations to be performed at step S12 include heat history correction, sharpness correction, printing ratio correction, temperature correction, and voltage correction that is a constituent feature of the present embodiment.

The heat history correction will be described below. Specifically, the thermal head 20 is normally composed of a plurality of heating elements associated with pixels. There is a possibility that adjoining heating elements may be affected by heat generated from the adjoining ones and may consequently fail to accurately restore a printing density. The heat history correction is therefore performed, wherein the possibility is inferred, in order to adjust a time during which a current is conducted to the thermal head 20.

The sharpness correction is achieved by adjusting the time during which a current is conducted to the thermal head 20 so as to enhance the edge of an image to be printed.

The printing ratio correction will be described below. That is to say, since the thermal head 20 is, as mentioned above, composed of a plurality of heating elements, it is normally necessary to detect how many heating elements that serve as resistors are turned on and to regulate a voltage according to the result of the detection. However, since a voltage developed from the battery 8 is fixed, the voltage regulation is impossible to do. Therefore, in the printing ratio correction, the heating elements that are turned on simultaneously during printing of one line are detected, and the time during which a current is conducted to the heating elements is adjusted. Thus, even if a total resistance varies by turning on or off the plurality of heating elements, a printing luminance can be restored reliably.

In the temperature correction, the photo-printing time during which the thermal head 20 works for photo-printing is adjusted based on the temperature of the thermal head 20 or ambient temperature. For example, when the temperature is low, the photo-printing time is extended. When the temperature is high, the photo-printing time is shortened.

The arithmetic operation unit 81*a* included in the CPU 81 performs an arithmetic operation required to perform each of the foregoing corrections. Moreover, a conducted current adjustment time during which a current to be conducted to the thermal head 20 is adjusted is calculated because it is needed to perform the various corrections.

Furthermore, according to the present embodiment, voltage correction is performed in order to stabilize a printing density of inks transferred from the thermal head 20 onto the print paper 6 and to thus produce a high-definition print.

To be more specific, the CPU 81 references a voltage correction table (see FIG. 7), which is preserved in the voltage correction unit 81*c*, using the voltage detected at step S11 (or the voltage and the result of measurement performed by the temperature measuring unit 20*a*). The CPU 81 executes the calculation of the correction coefficient used to work out an applied current adjustment time during which a current to be conducted to the thermal head 20 is adjusted.

For example, according to the present embodiment, as seen from the characteristic curve of FIG. 7 that is provided as the voltage correction table, a probability by which a minimum operating voltage guaranteed by the battery 8 is applied shall be 100%. The voltage correction unit 81*c* works out a correction coefficient used to calculate the applied current adjustment time during which a current to be conducted to the thermal head 20 is adjusted. At this time, the correction coefficient is determined so that the percentage (application percentage) will be decreased with every rise of a detected voltage value.

According to the present embodiment, the minimum operating voltage is, as shown in FIG. 7, set to, for example, 6.9 V. If a voltage detected at step S11 is equal to the minimum operating voltage 6.9 V, printing is performed at a maximum density (100%). Moreover, the present embodiment has been described on the assumption that the minimum operating voltage is set to 6.9 V. However, the present invention is not limited to the voltage value as long as a photo-printing density can be set to the maximum density of 100%.

According to the present embodiment, if the CPU 81 judges that a voltage detected at step S11 falls below the minimum operating voltage of 6.9 V and judges from the result of measurement performed by the temperature measuring unit 20*a* that the temperature of the thermal head 20 is high, the CPU 81 controls the voltage correction unit 81*c* so that an excess-correction will be performed to such an extent that 100% will not be exceeded. (Herein, the excess-correction is a correction that provides a relationship of the minimum operating voltage expressed as an extension, which is not shown, of the characteristic curve shown in FIG. 7.) Thus, an arithmetic operation may be performed in order to work out a correction coefficient. In this case, the correction coefficient is provided as a virtual density to be set so that the product of the virtual density by a density provided as a correction coefficient determined with the result of measurement performed by the temperature measuring unit 20*a* will not exceed the maximum density of 100%. Herein, when the detected voltage value is smaller than the minimum operating voltage value of 6.9 V, the correction coefficient assumes a value larger than the maximum density.

As mentioned above, the CPU 81 uses the arithmetic operation unit 81*a* and voltage correction unit 81*c* to perform various arithmetic operations required for corrections at step S12. This results in an applied current adjustment time, during which a current to be conducted to the thermal head 20 is adjusted in order to print an image at an accurate and stable photo-printing density according to print data. At step S13, the CPU 81 controls the printing controller 87 so that the thermal head 20 will be driven according to the calculated applied current adjustment time in order to start printing of one line with the first color ink (Y).

When a predetermined number of lines are printed in the direction of the width of print paper using the heating elements, the print paper 6 and ink ribbon 7*a* are fed. A predetermined number of subsequent lines are then printed. Hereafter, likewise, printing using the thermal head 20 and feeding of the print paper 6 and ink ribbon 7*a* are repeated. Printing is thus achieved. The CPU 81 judges at step S14 whether printing of all lines has been completed. If it is judged that printing of all lines has not been completed, control is returned to step S12. If it is judged that printing of all lines has been completed, control is returned to step S15.

At step S15, the CPU 81 returns paper to the initial printing position and judges whether transfer of the transparent overcoat (OP) has been completed (whether transfer of all four color inks of yellow, magenta, cyan, and transparent overcoat have been completed). If it is judged that transfer of the transparent overcoat (OP) has not been completed, the CPU 81 returns control to step S11. In other words, the routine composed of steps S11 to S14 is executed for each of the first color ink of yellow (Y), the second color ink of magenta (M), the third color ink of cyan (C), and the transparent overcoat (OP).

If it is judged at step S15 that transfer of the transparent overcoat (OP) has been completed, the CPU 81 discharges printed paper and returns control to step S7. Thus, the printer 1 is brought to a wait state in which a press of the Print button 30*b* is awaited.

According to the present embodiment, the table data (correction coefficient) used to perform an arithmetic operation required for voltage correction and shown in FIG. 7 is provided in the same form of a characteristic curve between transfer of the three primary color inks of yellow, magenta, and cyan and transfer of the transparent overcoat (OP) used to protect the surface of print paper. Moreover, the table data used for voltage correction is not limited to the characteristic curve shown in FIG. 7. Alternatively, a plurality of table data items may be provided in the form of different characteristic curves. Any of the table data items may be selected based on ambient temperature at which the printer is used. The selected table data may then be used to perform voltage correction prior to each of four transfers of four color inks. Thus, the printer can offer stable performance despite a change in ambient temperature at which it is used.

According to the present embodiment, the battery 8 develops a stable predetermined voltage after completion of charging. The minimum operating voltage is lower than the stable predetermined voltage developed after completion of charging. For example, the present embodiment has been described on the assumption that the stable voltage developed from the battery 8 after completion of charging is, as shown in FIG. 5, 7.6 V. In reality, when the voltage developed from the battery 8 is measured with no load connected immediately after completion of charging, the measured voltage is 8 V. After printing of one sheet of paper is completed, the measured voltage is 7.4 V. Thereafter, as long as the battery capacity is sufficiently large, the measured voltage value remains 7.4 V. As the battery capacity decreases largely, the measured voltage value gets smaller than 7.4 V. Therefore, according to the present embodiment, printing with 7.4 V is regarded as standard printing. Moreover, 6.9 V is set as a lower limit permitting printing (minimum operating voltage) as mentioned above. Printing with 6.9 V is regarded as printing performed at a maximum density.

According to the first embodiment, power supplied from the battery 8 is conducted to the thermal head 20, which is a load, immediately prior to each transfer of the color inks for color printing. Since a voltage developed from the battery 8 can be measured on a stable basis during a certain period alone immediately succeeding discontinuation of the power feeding, the voltage is detected at this timing. Based on the result of the detection, a current to be conducted to the thermal head 20 is corrected in order to stabilize a printing density. Even when a detected voltage is lower than the minimum operating voltage of 6.9 V, if the temperature of the thermal head 20 is high enough, power to be applied to the thermal head can be reduced. Therefore, a virtual density is set to exceed a maximum density by performing a transient arithmetic operation. Correction is performed so that printing can be achieved on a stable basis using a final correction coefficient that does not exceed the maximum density. This leads to an expanded range of operating voltages permitting printing by the portable printer. Moreover, printing can be achieved with sufficiently stable image quality ensured. Thus, the present embodiment largely contributes to improvement of the performance of a printer.

Moreover, the thermal head 20 is utilized as a load during battery checking or voltage detection. Consequently, the thermal head can be pre-heated, and a total battery capacity exhausted in order to generate required thermal energy can be minimized. This results in an increase in the number of printed paper that can be produced using a battery of the same capacity.

Consequently, there is provided an unprecedented heat-sensitive heat-transfer printer that is user-friendly, excellent in performance, portable, and battery-driven.

Figure 8:
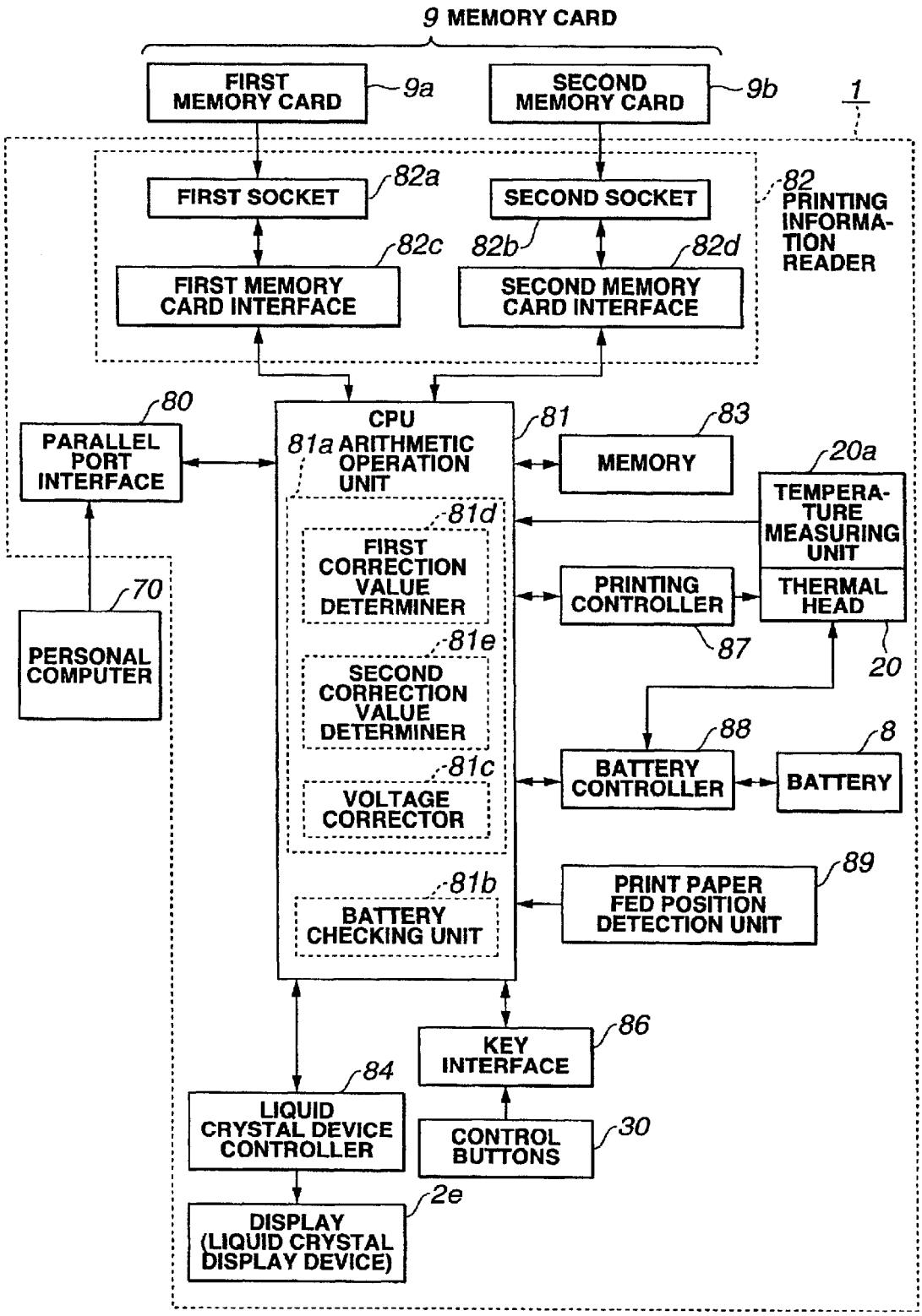
FIG. 8 is a block diagram showing the electrical circuitry of a major portion of a printer in accordance with a second embodiment of the present invention.
Figure 9:
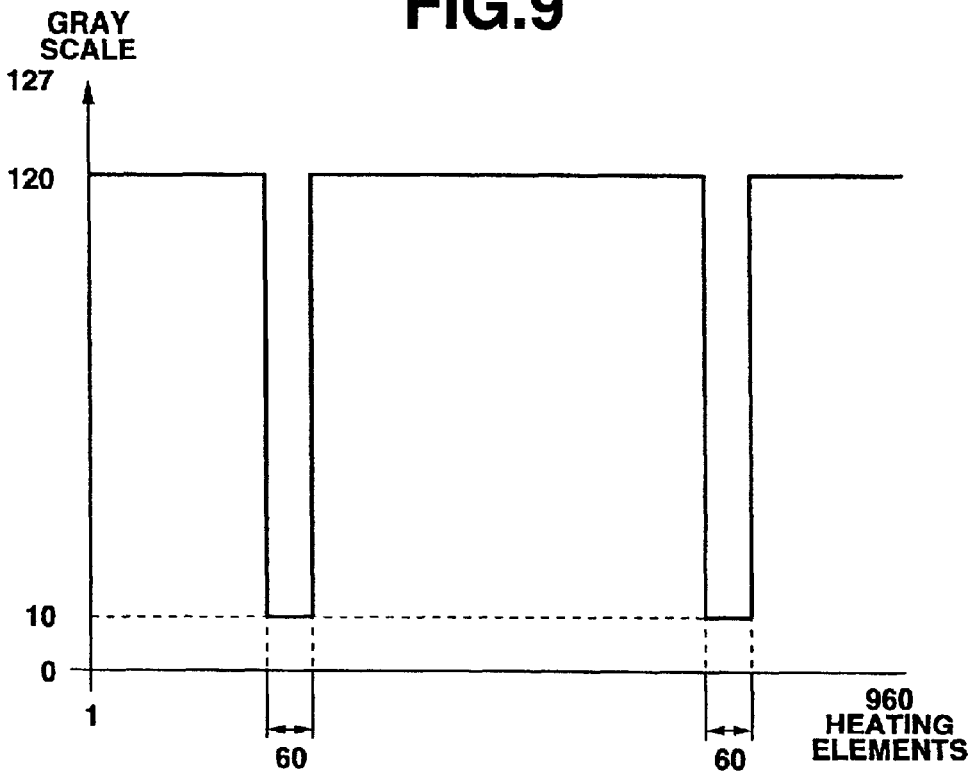
FIG. 9 is concerned with the second embodiment, showing the relationship between the number of on heating elements and a gray-scale level specified in image data representing one line to be photoprinted.
Figure 10:
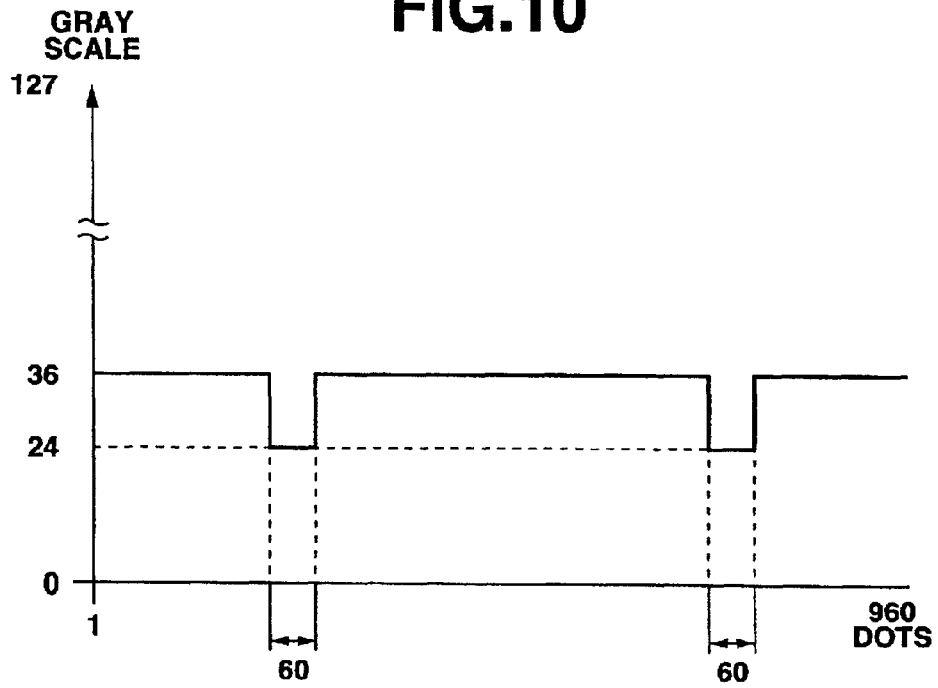
FIG. 10 is concerned with the second embodiment, showing the relationship between the number of on heating elements and a gray-scale level specified in image data representing another line.
Figure 11:
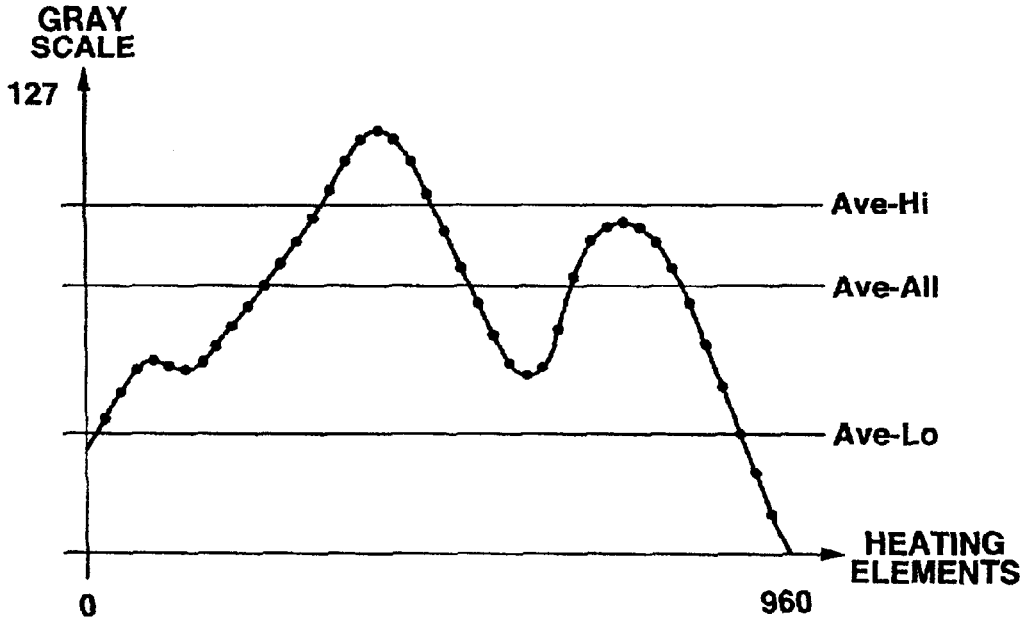
FIG. 11 is a graph for explaining a printing ratio correction method that features the second embodiment.
Figure 12:
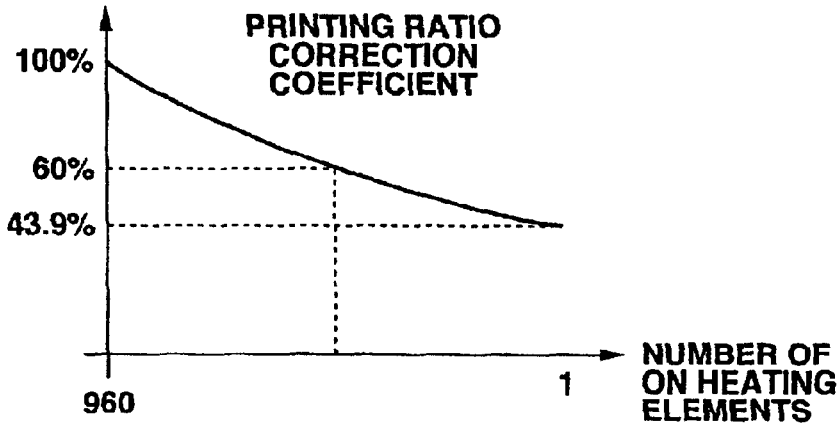
FIG. 12 is concerned with the second embodiment, showing a characteristic curve provided as table data that represents a correction coefficient for a printing ratio to be employed in a printing ratio correction.
Figure 13:
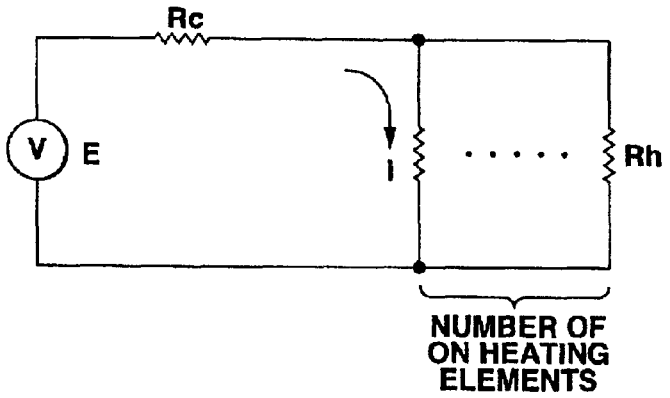
FIG. 13 is a circuit diagram concerned with the second embodiment and schematically showing the basic circuitry of a heat-sublimable printer suitable for portable use.
Figure 14:
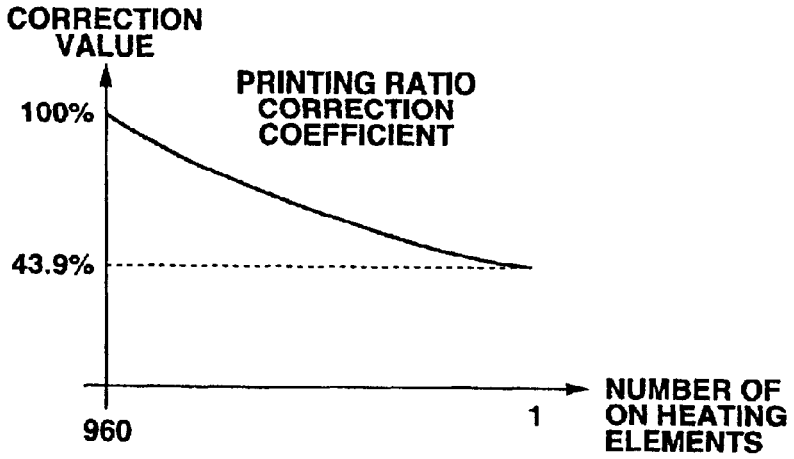
FIG. 14 is concerned with the second embodiment, showing a characteristic curve provided as table data that represents a correction coefficient for a printing ratio to be employed in printing ratio correction.
Figure 15:
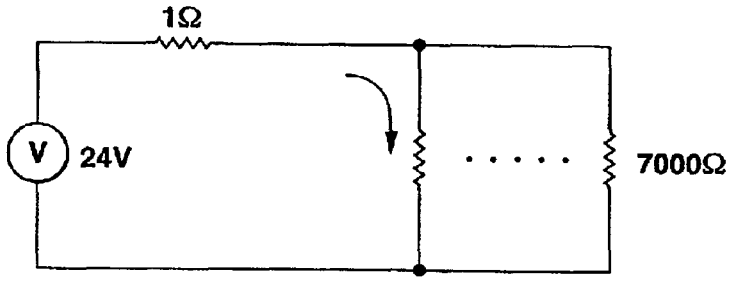
FIG.15 RELATED ART
FIG. 15 is a circuit diagram schematically showing the circuitry of a conventional printer having an ordinary power supply.

FIG. 8 to FIG. 14 show a second embodiment of a printer in accordance with the present invention. FIG. 8 is a block diagram showing the electrical circuitry of a major portion mounted in the printer. FIG. 9 shows a relationship between the number of on heating elements and a gray scale specified in gray-scale data that represents one line to be printed. FIG. 10 shows a relationship between the number of on heating elements and a gray scale specified in gray-scale data that represents another line. FIG. 11 is an explanatory diagram concerning a printing ratio correcting method that is a constituent feature of the second embodiment. FIG. 12 is a characteristic curve that is provided as table data and indicates a printing ratio correction coefficient used to correct a printing ratio. FIG. 13 is a circuit diagram schematically showing the basic components of a heat-sublimable printer suitable for portable use. FIG. 14 is a characteristic curve that is provided as table data and indicates a printing ratio correction coefficient used to correct a printing ratio. In the second embodiment, the same reference numerals are assigned to components identical to those of the first embodiment, and the description of the components is omitted. Moreover, in the second embodiment, the drawings referred to in explanation of the first embodiment will be used if necessary.

The printer of the second embodiment is, as shown in FIG. 1 and FIG. 2, designed to employ a battery power supply so as to be used as a portable printer. Due to this design, even when a correction used to correct a current cannot help ranging widely, printing can be achieved with sufficiently stable image quality ensured since correction is achieved highly precisely.

Specifically, a printer 1 of the second embodiment has components shown in FIG. 8 in efforts to offer improved performance even when a battery is adopted as a power supply. Owing to the components, a printing ratio is calculated relative to each gray-scale level specified in image data representing one line contained in a color image to be printed. A first correction value is determined based on the printing ratio. A second correction value is determined based on the result of an arithmetic operation performed using all gray-scale data items according to which all the heating elements included in a thermal head 20 are heated in order to print one line according to the image data. The amount of heat generated by each heating element included in the thermal head 20 is controlled based on the first and second correction values. Thus, correction is achieved highly precisely.

A CPU 81 serving as a control means includes at least an arithmetic operation unit 81*a* and a battery checking unit 81*b* therein. The arithmetic operation unit 81*a* includes at least a first correction value determiner 81*d* and a second correction value determiner 81*e*. The arithmetic operation unit 81*a* also includes a voltage corrector 81*c*.

In order to execute printing ratio correction, the first correction value determiner 81*d* included in the arithmetic operation unit 81 of the CPU 81 calculates a printing ratio relative to each gray-scale level specified in image data that represents one line. A correction value is then determined based on the printing ratio. When one line represented by the image data is printed, the second correction value determiner 81*e* performs an arithmetic operation using gray-scale data items according to which all the heating elements are heated in order to print one line according to the image data. A correction values is then determined based on the result of the arithmetic operation.

The two correction values needed to execute printing ratio correction that is a constituent feature of the second embodiment are obtained as the results of arithmetic operations by the first and second correction value determiners 81*d* and 81*e*. Thereafter, the CPU 81 controls the amounts of heat generated by the heating elements included in the thermal head 20 according to the two correction values.

Thus, a printing density of inks transferred from the thermal head 20 remains constant irrespective of whether a voltage developed from the battery 8 is high or low. Correction can be performed in compliance even with a large voltage drop dependent on the degree of exhaustion of the battery 8. Moreover, the correction can be achieved highly precisely. Eventually, printing can be performed with satisfactorily stable image quality ensured.

Next, an operation exerted by the printer 1 of the second embodiment will be described by mainly discussing differences from the first embodiment.

The corrections that require arithmetic operations and are performed by the CPU 81 at step S12 described in FIG. 4 are, for example, heat history correction, sharpness correction, voltage correction, and temperature correction. In addition, there is printing ratio correction that is a constituent feature of the second embodiment. By performing these corrections, a printing density of inks transferred from the thermal head 20 onto the print paper 6 is stabilized. This results in high-definition prints.

The printing ratio correction will be described below. That is to say, since the thermal head 20 includes, as mentioned above, a plurality of heating elements, how many heating elements that serve as resistors are turned on is detected normally. A voltage is regulated based on the result of the detection. However, since a voltage to be developed from the battery 8 is fixed, the voltage regulation is impossible to adjust the voltage. In the printing ratio correction, therefore, what heating elements are turned on in order to print one line is detected, and the current applying time during which a current is conducted to the heating elements is adjusted. The plurality of heating elements are thus turned on or off. Owing to the correction, even if a total resistance varies, a printing density can be attained accurately.

According to the second embodiment, gray-scale data items specified in all pixels representing dots that constitute one line to be printed are analyzed. A correction value used to correct remaining heat is determined based on the result of the analysis. This is different from inference of remaining heat from each pixel. The second embodiment is described on the assumption that the correction value assumes the same value relative to all pixels representing dots that constitute one line or to all gray-scale levels specified in the pixels. The present invention is not limited to this mode. Alternatively, the correction value may assume different values.

To be more specific, when the CPU 81 executes printing ratio correction, the CPU 81 uses the first correction factor determiner 81*d* included in the arithmetic operation unit 81*a* to calculate a printing ratio relative to each gray-scale level specified in image data representing one line. A correction value is then determined based on calculated printing ratios.

In other words, as shown in FIG. 13 and FIG. 14, the printing ratio correction is analogous to printing ratio correction performed in a printer optimal to portable use (for example, a printer having 7.6 V and 750 Ω adopted as a supply voltage and a resistance offered by a thermal head respectively). Namely, the CPU 81 controls the first correction determiner 81*d* so that the first correction determiner 81*d* will work out a correction value. Herein, when a minimum current flows (a current flows into 960 heating elements because the heating elements are turned on), a correction value shall be 100%. When the number of heating elements that are turned on is 1, the correction value is calculated as 43.9% from the numerical values provided by the aforesaid expressions 2 and 3. In practice, the CPU 81 references the data of printing ratio correction coefficients (see FIG. 12 and FIG. 14) preserved in the arithmetic operation unit 81*a* so as to obtain the correction value of 43.9%.

As far as the printing ratio correction employed in the Second embodiment is concerned, what is conducted to the thermal head 20 is, as mentioned above, a pulsating current. During the conduction of a current, a voltage and a current are controlled to remain constant all the time under the control of the CPU 81. Assume that the number of heating elements used to print one line is 960 and the number of gray-scale levels is 128. It is detected how many heating elements among 960 heating elements are turned on in order to photoprint the first gray-scale level of one line. A current is then corrected as described in conjunction with FIG. 13 and FIG. 14. In this case, theoretically speaking, the current must be reduced. In reality, the current is set to a fixed value, and the number of current pulses to be applied is decreased. Thus, the same result of photo-printing as that provided when the current is reduced is provided. In other words, the voltage and current are set to fixed values all the time, and all the pulses constituting the current are thinned out by the number of pulses corresponding to a current value by which the current must be reduced.

For example, assume that a maximum number of pulses to be applied in order to photoprint each gray-scale level is 100. When a current need not be reduced at all, the CPU 81 controls the printing controller 87 so that 100 pulses will be applied to the thermal head 20. When the current need to be reduced even slightly, the CPU 81 controls the printing controller 87 so that the number of applied pulses will be smaller than 100. In order to photoprint the first gray-scale level, a current reduction request value is calculated through the aforesaid correction (correction performed using a correction value determined by the first correction value determiner 81*d*). The CPU 81 controls the printing controller 87 so that the number of applied pulses will be decreased by the number of pulses equivalent to the requested value. For example, when a current must be reduced by 30%, 70 pulses are applied. Thus, photo-printing of the first gray-scale level is completed.

Thereafter, photo-printing of the second gray-scale level is started. Similarly to photo-printing of the first gray-scale level, the CPU 81 uses the first correction value determiner 81*d* to detect how may heating elements among 960 heating elements are turned on. Printing ratio correction is then performed similarly. If the number of heating elements to be turned on is the same between photo-printing of the first gray-scale level and photo-printing of the second gray-scale level, the correction value used to correct a current value is the same between them. If the number of heating elements to be turned on in order to photoprint the second gray-scale level is smaller, the correction value is different from the one used to photoprint the first gray-scale level. That is to say, the correction value indicates that the number of pulses to be applied is different from the number of pulses to be applied in order to photoprint the first gray-scale level.

However, when printing ratio correction is performed based on the above correction value, the correction ranges widely as described in relation to the related art. This disables high-precision correction.

A description will be made using examples of gray-scale data representing one line shown in FIG. 9 and FIG. 10. In the example shown in FIG. 9, the 960 heating elements of the thermal head 20 create 960 dots on a one-to-one correspondence basis. Among the 960 dots, 120 dots photoprint gray-scale level 10 (assuming that the maximum gray-scale level is, for example, level 127), and the remaining 840 dots photoprint gray-scale level 120. In this case, as shown in FIG. 9, at the steps of photo-printing gray-scale levels 0 to 9, all the 960 heating elements responsible for the 960 dots are turned on. At the steps of photo-printing gray-scale levels 10 to 119, the heating elements responsible for 840 dots are turned on. At the steps of photo-printing gray-scale levels 120 and more, none of the heating elements is turned on.

In the example shown in FIG. 10, for drawing one line of an image to be printed, the 960 heating elements of the thermal head 20 create 960 dots on a one-to-one correspondence basis. Among the 960 dots, 120 dots photoprint gray-scale level 24 (assuming that the maximum gray-scale level is level 127). The remaining 840 dots photoprint gray-scale level 36. In this case, at the steps of gray-scale levels 0 to 23, all the 960 heating elements responsible for the 960 dots are turned on. At the step of photo-printing gray-scale levels 24 to 35, the heating elements responsible for 840 dots are turned on. At the steps of photo-printing gray-scale level 36 and higher, none of the heating elements is turned on. As mentioned above, the number of heating elements included in the thermal head that are turned on is the same between the cases of FIG. 9 and FIG. 10. However, the higher a gray-scale level is, the longer a conduction time during which a current is conducted to a heating element is. Consequently, a photo-printing time during which an operating voltage is applied to the thermal head is different between the cases of FIG. 9 and FIG. 10. In this case, even when printing ratio correction is performed using the same correction value calculated as mentioned above, the correction does not work equally between the cases of FIG. 9 and FIG. 10. Specifically, a correction coefficient that is optimal to image data that specifies the gray scale shown in FIG. 9 is not always suitable for image data that specifies the gray scale shown in FIG. 10. On the contrary, the correction coefficient may bring about an excess-correction when applied to the image data specifying the gray sale shown in FIG. 10. Consequently, high-precision correction cannot be achieved.

According to the second embodiment, the CPU 81 uses the second correction value determiner 81*e* of the arithmetic operation unit 81*a* to perform an arithmetic operation using all gray-scale data items according to which the all heating elements of the thermal head 20 are heated for printing of one line. A correction value is then determined based on the results of the arithmetic operation.

To be more specific, assume that image data representing one line specifies a gray scale as shown in FIG. 11. The CPU 81 uses the second correction value determiner 81*e* to calculate a weighted average of gray-scale levels Ave-All specified in the image data representing one line. Thereafter, an average of gray-scale levels Ave-Hi higher than the weighted average level Ave-All is calculated, and an average of gray-scale levels Ave-Lo lower than the weighted average level Ave-All is calculated. The average level Ave-Lo is subtracted from the average level Ave-Hi, whereby a printing ratio correction coefficient a is calculated. In this case, a relational expression concerning the arithmetic operation required for printing ratio correction is provided as follows:

$$E' = E \times \alpha \tag{6}$$

where E' denotes energy provided after completion of printing ratio correction (the number of pulses), E denotes theoretical energy (on which a corrected printing ratio is not reflected), and a denotes a final-printing ratio correction coefficient ($0<\alpha\leqq 1$). The final-printing ratio correction coefficient a approaches zero as the number of heating elements that are turned on in order to create dots gets smaller.

$$\alpha = (1-\beta)\times\gamma+\beta \tag{7}$$

where $\beta$ denotes a general printing ratio correction coefficient ($0<\beta\leqq 1$), and $\gamma$ denotes a current new correction coefficient ($0\leqq\gamma\leqq 1$). As the difference between the average level Ave-Hi and the average level Ave-Lo gets smaller, the new correction coefficient $\gamma$ approaches 1.

Consequently, referring to FIG. 11, assume that the average level Ave-All is calculated when the number of heating elements that are turned on to create dots is 480. In this case, the CPU 81 references the data of printing ratio correction coefficients shown in FIG. 14 so as to work out a printing ratio correction coefficient of 60%. The printing ratio correction coefficient is multiplied by the printing ratio correction coefficient a that is calculated by subtracting the average level Ave-Lo from the average level Ave-Hi. This results in a final correction value.

During the printing ratio correction in accordance with the second embodiment, the first and second correction value determiners 81*d* and 81*e* perform an arithmetic operation to obtain two correction values that are needed to execute printing ratio correction which is a constituent feature of the second embodiment. Thereafter, the CPU 81 controls the amounts of heat to be generated from the heating elements included in the thermal head 20 according to the two correction values.

According to the second embodiment, the characteristic curves shown in FIG. 7 and FIG. 12 respectively are adopted as table data (representing a correction coefficient) that is needed to perform an arithmetic operation required for voltage correction, and table data that is needed to perform an arithmetic operation required for printing ratio correction. The characteristic curves are used in common among transfer of three primary color inks (Y, M, and C) and transfer of a transparent overcoat used to protect the surface of print paper. Moreover, the table data is not limited to the characteristic curves shown in FIG. 7 and FIG. 12. Alternatively, similarly to the first embodiment, a plurality of table data items provided as different characteristic curves may be preserved. Any of the plurality of table data items may be selected based on ambient temperature at which the printer is used. The selected table data may then be used to perform voltage correction and printing ratio correction during transfer of each of the four color inks.

According to the second embodiment, immediately before each color ink is transferred for color printing, power supplied from the battery 8 is fed to the thermal head 20 that is a load. At the timing immediately succeeding discontinuation of the feeding of power, a voltage developed from the battery 8 is detected. Based on the result of the detection, the voltage is controlled in order to correct conduction of a current to the thermal head 20 for the purpose of stabilizing a printing density. Furthermore, the first correction value determiner 81*d* calculates a printing ratio relative to each gray-scale level specified in image data representing one line. A correction value is determined based on calculated printing ratios. The second correction value determiner 81*e* performs an arithmetic operation using all gray-scale data items based on which the all heating elements are heated in order to print one line according to image data that contains the gray-scale data. A correction value is then generated based on the result of the arithmetic operation. The CPU 81 controls the amounts of heat to be generated by the heating elements included in the thermal head 20 according to the correction values determined by the first and second correction value determiners 81*d* and 81*e*. Consequently, high-precision correction can be achieved. This results in prints of satisfactorily stable image quality and improved performance of a printer.

Having described the preferred embodiments of the invention referring to the accompanying drawings, it should be understood that the present invention is not limited to those precise embodiments and various changes and modifications thereof could be made by the one skilled in the art without departing from the spirit or scope of the invention as defined in the appended claims.

What is claimed is:

1. A printer comprising:

a thermal head for transferring a plurality of color inks successively to paper so that a color image can be printed on the paper according to image data;

battery power supply means;

voltage detecting means for detecting a voltage developed from said battery power supply means; and control means for feeding power supplied from said battery power supply means to a load at the timing immediately preceding the transfer of the color inks to the paper, instructing said voltage detecting means to detect the voltage developed from said battery power supply means at the predetermined timing immediately succeeding the feeding of power, and performing correction according to the result of the detection so that a printing density of inks transferred from said thermal head will remain constant irrespective of whether the voltage developed from said battery power supply is high or low, wherein:

the predetermined timing is found within a period which, after power feeding of a predetermined period, immediately succeeds discontinuation of the feeding of power, which is supplied from said battery power supply to the load for a predetermined time; and during the period, the voltage developed from said battery power supply remains substantially constant.

2. The printer according to claim 1, wherein the predetermined timing is found with a period of 5 to 10 msec long immediately succeeding discontinuation of feeding of power, which is supplied from said battery power supply means to the load for a predetermined time.

3. A printer comprising:

a thermal head for transferring a plurality of color inks successively to paper so that a color image can be printed on the paper according to image data;

battery power supply means;

battery detecting means for conducting a current to a first load so as to detect a remaining battery capacity of said battery power supply means;

display means for, when the remaining battery capacity detected by said battery detecting means is judged to be equal to or smaller than a battery capacity required for printing, displaying at least an indication of the fact;

voltage detecting means for detecting a voltage developed from said battery power supply means; and control means for feeding power, which is supplied from said battery power supply means, to a second load smaller than said first load at the timing immediately preceding the transfer of the color inks to the paper, then instructing said voltage detecting means to detect the voltage, which is developed from said battery power supply means, at the predetermined timing immediately succeeding the feeding of power, and then performing correction according to the result of the detection so that a printing density of inks transferred from said thermal head will remain constant irrespective of whether the voltage developed from said battery power supply means is high or low.

4. The printer according to claim 3, wherein the first load is said thermal head to which a current is conducted, and the second load is said thermal head to which a current is conducted for a time shorter than a time for which a current is conducted to the first load.

5. The printer according to claim 3, wherein the first load is said thermal head to which a plurality of current pulses is applied, and the second load is said thermal head to which a plurality of current pulses that numbers smaller than the plurality of current pulses applied to the first load is applied.

6. A printer comprising:

a thermal head for transferring a plurality of color inks successively to paper so that a color image can be printed on the paper according to image data;

battery power supply means;

voltage detecting means for detecting a voltage developed from said battery power supply means; and control means for feeding power, which is supplied from said battery power supply means, to a load at the timing immediately preceding the transfer of the color inks to the paper, then instructing said voltage detecting means to detect the voltage, which is developed from said battery power supply means, at the predetermined timing immediately succeeding the feeding of power, and then performing correction according to the result of the detection so that a printing density of inks transferred from said thermal head will remain constant irrespective of whether the voltage developed from said battery power supply means is high or low, wherein said voltage detecting means detects battery voltages respectively at different times under different load conditions for said batter power supply means prior to commencing a print operation, and wherein said control means calculates a printing ratio defined by the thermal energy generated by the load based on the number of loads activated simultaneously and the voltages detected by said voltage detecting means and controls power application duration of the load in accordance with the printing ratio.

7. The printer according to claim 6, wherein when the same voltage is detected among transfers of the color inks and transparent overcoat, the correction value is determined to assume the same value among the transfers.

8. A printer comprising:

a thermal head for transferring a plurality of color inks successively to paper so that a color image can be printed on the paper according to image data;

battery power supply means;

voltage detecting means for detecting a voltage developed from said battery power supply means; and control means for feeding power, which is supplied from said battery power supply means, to a load at the timing immediately preceding the transfer of the color inks to the paper, then instructing said voltage detecting means to detect the voltage, which is developed from said battery power supply means, at the predetermined timing immediately succeeding the feeding of power, and performing correction according to the result of the detection so that a printing density of the inks transferred from said thermal head will remain constant irrespective of whether the voltage developed from said battery power supply means is high or low, wherein when the voltage detected by said voltage detecting means is a first voltage, the correction performed by said control means results in printing at a maximum density.

9. The printer according to claim 8, wherein said battery power supply means develops a predetermined stable voltage after completion of charging, and the first voltage shall be lower than the predetermined voltage.

10. The printer according to claim 8, further comprising a thermal head temperature measuring means, wherein:

when a correction value is determined so that when the result of measurement performed by said temperature measuring means is predetermined temperature, printing will be performed at a maximum density;

when the result of measurement performed by said temperature measuring means is higher than the predetermined temperature and the voltage detected by said voltage detecting means is lower than the first voltage, a correction value used to correct the voltage is provided as a virtual density to be set so that a product of the virtual density by a density provided as a correction value determined based on the result of measurement performed by said temperature measuring means will not exceed the maximum density.

11. A printer comprising:

a thermal head having a plurality of heating elements arranged therein in order to print a color image on paper according to image data;

first correction value determining means for calculating a printing ratio relative to each gray-scale level specified in image data representing one line, and determining a correction value according to calculated printing ratios;

second correction value determining means for performing an arithmetic operation using all gray-scale data items, based on which said all heating elements are heated for printing one line according to the image data, and determining a second correction value according to the result of the arithmetic operation; and control means for controlling the amounts of heat to be generated from said heating elements according to the correction values determined by said first and second correction value determining means.

12. The printer according to claim 11, wherein said second correction value determining means calculates a sum total of all gray-scale levels based on which said all heating elements are heated for printing one line according to the image data, and determines a correction value according to the sum total.

13. The printer according to claim 12, wherein said second correction value determining means works out an average level from the calculated sum total, calculates a first average of gray-scale levels exceeding the average level, calculates a second average of gray-scale levels falling below the average level, and determines a correction value according to the first and second averages.

14. The printer according to claim 13, wherein said second correction value determining means determines a correction value according to a difference between the first and second averages.

15. The printer according to claim 11, wherein controlling the amounts of heat is achieved by varying only a power feeding time during which power is fed to each heating element.

* * * * *